US010116063B2

(12) United States Patent
Haro et al.

(10) Patent No.: US 10,116,063 B2
(45) Date of Patent: Oct. 30, 2018

(54) INTERNALLY FED DIRECTIONAL FOLDED YAGI ANTENNA ASSEMBLIES

(71) Applicant: Laird Technologies, Inc., Earth City, MO (US)

(72) Inventors: Rafael Haro, Chicago, IL (US); Alejandro Manuel Mascorro, Broadview, IL (US); Sajid Ali Safvi, Lombard, IL (US); Benjamin Peter Hoffman, Crystal Lake, IL (US)

(73) Assignee: LAIRD TECHNOLOGIES, INC., Earth City, MO (US)

( * ) Notice: Subject to any disclaimer, the term of this patent is extended or adjusted under 35 U.S.C. 154(b) by 239 days.

(21) Appl. No.: 15/154,814

(22) Filed: May 13, 2016

(65) Prior Publication Data

US 2017/0331198 A1 Nov. 16, 2017

(51) Int. Cl.

| | |
|---|---|
| ***H01Q 19/30*** | (2006.01) |
| ***H01Q 1/12*** | (2006.01) |
| ***H01Q 9/26*** | (2006.01) |

(52) U.S. Cl.

CPC ..... *H01Q 19/30* (2013.01); *H01Q 1/1242* (2013.01); *H01Q 9/265* (2013.01)

(58) Field of Classification Search

CPC . H01Q 11/10; H01Q 9/26; H01Q 1/46; H01Q 19/30; H01Q 1/1242; H01Q 3/00

See application file for complete search history.

(56) References Cited

U.S. PATENT DOCUMENTS

| | | | | |
|---|---|---|---|---|
| 4,604,628 | A | 8/1986 | Cox | |
| 5,068,672 | A | 11/1991 | Onnigian et al. | |
| 5,111,214 | A | 5/1992 | Kumpfbeck et al. | |
| 5,489,915 | A * | 2/1996 | Bortniker | H01Q 1/08 343/818 |
| 5,621,421 | A | 4/1997 | Kolz et al. | |
| 5,657,030 | A | 8/1997 | Peck et al. | |
| 5,999,141 | A | 12/1999 | Weldon | |
| 6,483,476 | B2 | 11/2002 | Cox | |
| 8,237,618 | B2 | 8/2012 | Wu | |

(Continued)

FOREIGN PATENT DOCUMENTS

| | | | | |
|---|---|---|---|---|
| CA | 2266996 | A1 * | 9/2000 | H01Q 1/1207 |
| JP | 2011239198 | A | 11/2011 | |
| KR | 20090101567 | A | 9/2009 | |

OTHER PUBLICATIONS

Directional Yagi Antenna With Folded Dipole Y6-4m 70-71 MHz:Radial: http://www.radial.ru/catalog/antennas/directional/y6-4m/eng/print; accessed Jan. 6, 2016, 2 pages.

(Continued)

*Primary Examiner* — Dieu H Duong

(74) *Attorney, Agent, or Firm* — Harness, Dickey & Pierce, P.L.C.; Anthony G. Fussner

(57) ABSTRACT

Exemplary embodiments are provided of internally fed directional folded Yagi antenna assemblies. In an exemplary embodiment, an antenna assembly generally includes a boom, a cable assembly, and a plurality of dipole elements spaced apart along the boom. The dipole elements include a folded dipole element. The feed cable assembly is internally fed inside the boom and a first section of the folded dipole element.

23 Claims, 48 Drawing Sheets

(56) References Cited

U.S. PATENT DOCUMENTS

2004/0262025 A1* 12/2004 Brandt ..... H02G 15/115
174/88 R
2014/0104116 A1* 4/2014 Chiu ..... H01Q 1/24
343/702

OTHER PUBLICATIONS

Directional Yagi Antennas Y(b)4506; www.lairdtech.com; Copyright 2010; 1 page.

* cited by examiner

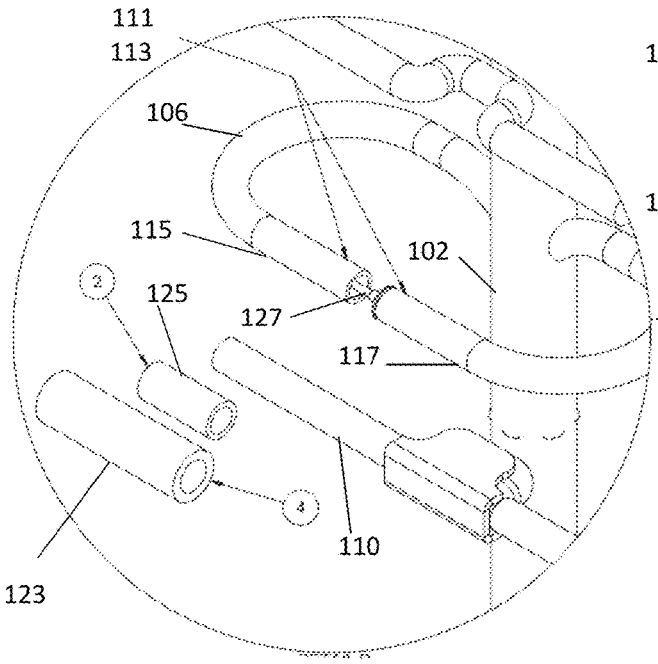
FIG. 6
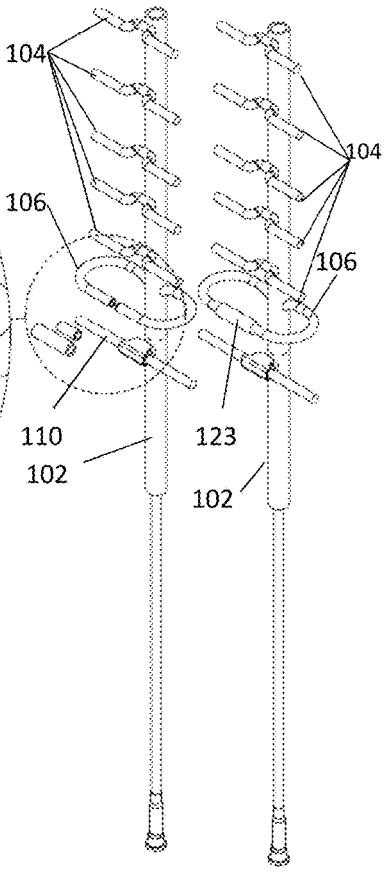
FIG. 5
FIG. 7

192

Radiation Patterns
890 MHz

Radiation Patterns
925 MHz

Radiation Patterns 960 MHz

Radiation Patterns
450 MHz

Elevation
Phi 90°

Azimuth
Phi 0°

Radiation Patterns
470 MHz

Radiation Patterns
490 MHz

Radiation Patterns Orientation

Radiation Patterns
890 MHz

Radiation Patterns 925 MHz

Azimuth
Phi 0°

Elevation
Phi 90°

Radiation Patterns
960 MHz

Radiation Patterns
450 MHz

Radiation Patterns
470 MHz

Radiation Patterns
490 MHz

INTERNALLY FED DIRECTIONAL FOLDED YAGI ANTENNA ASSEMBLIES

FIELD

The present disclosure generally relates to internally fed directional folded Yagi antenna assemblies.

BACKGROUND

This section provides background information related to the present disclosure which is not necessarily prior art.

A Yagi-Uda antenna (commonly known as Yagi antenna) is a common antenna design. A conventional Yagi antenna includes multiple parallel elements in a line. The elements may be supported along their centers on a perpendicular crossbar or boom. The Yagi antenna may include a driven element connected to a transmission line and other parasitic elements, such as reflectors or directors. Yagi antennas are commonly used for focused directional and fixed-frequency uses. While Yagi antennas are often lightweight and inexpensive, the transmission line and other sensitive parts of the antenna assembly are exposed to the environmental elements (e.g., dirt, dust, water, etc.) and susceptible to damage thereby. Such exposure and damage leads to downtime and required maintenance of the antenna assembly.

DRAWINGS

The drawings described herein are for illustrative purposes only of selected embodiments and not all possible implementations, and are not intended to limit the scope of the present disclosure.

FIG. 5 is a perspective view of the antenna assembly shown in FIG. 1, and also illustrating a rubber tube and a heat shrink tube that may be disposed over a center conductor of the second cable where the center conductor extends between and across a gap separating the end portions of the folded dipole element;

FIG. 6 is a perspective view of the portion of the antenna assembly circled in FIG. 5, and further illustrating the rubber tube, heat shrink tube, and center conductor of the second cable extending between and across the gap separating the end portions of the folded dipole element;

FIG. 7 is a perspective view of the antenna assembly shown in FIG. 5 after the rubber tube and heat shrink tube have been assembled generally over the end portions of the folded dipole element;

Figure 43:
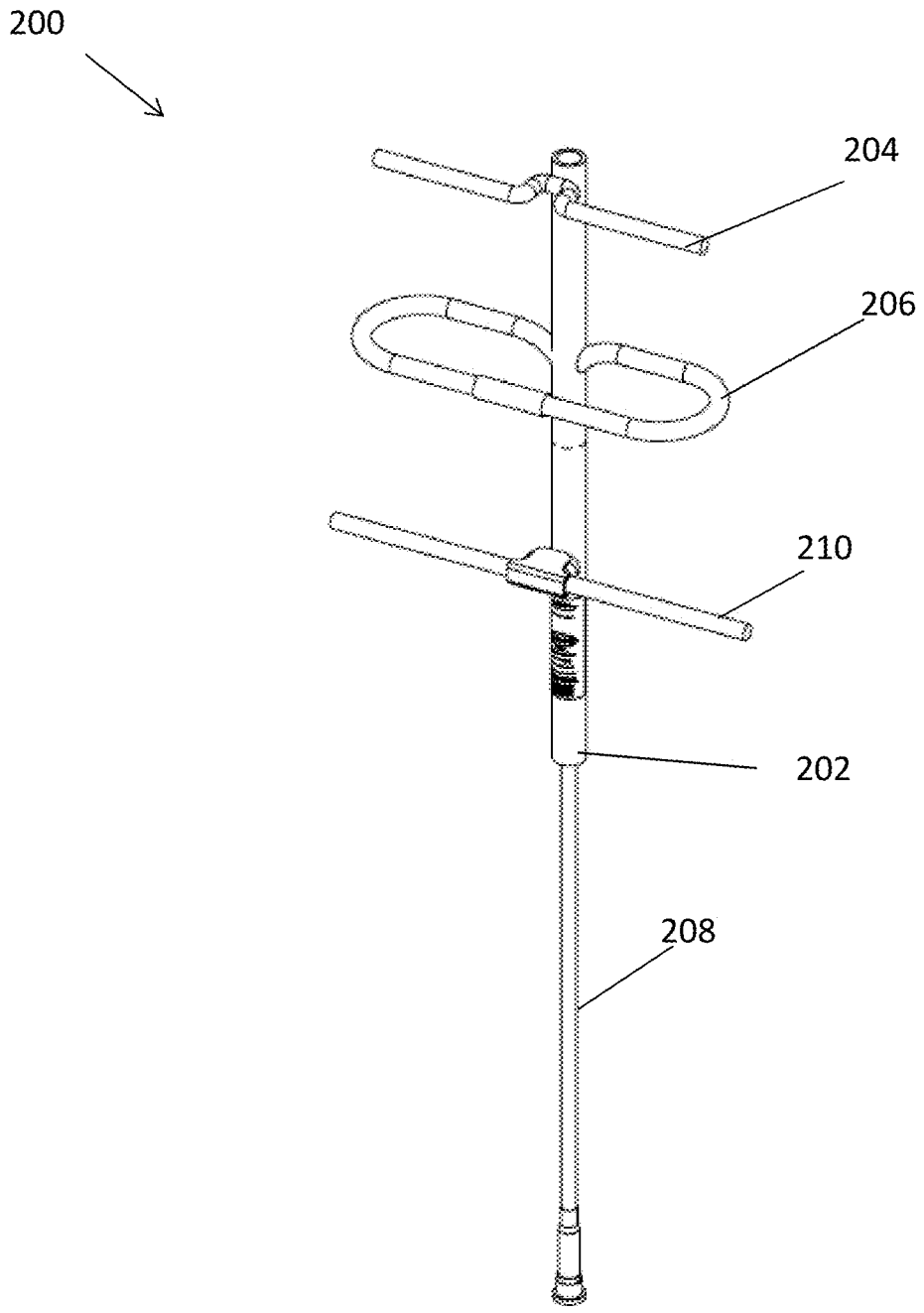
FIG. 43 is a perspective view of an antenna assembly according to another exemplary embodiment.
Figure 66:
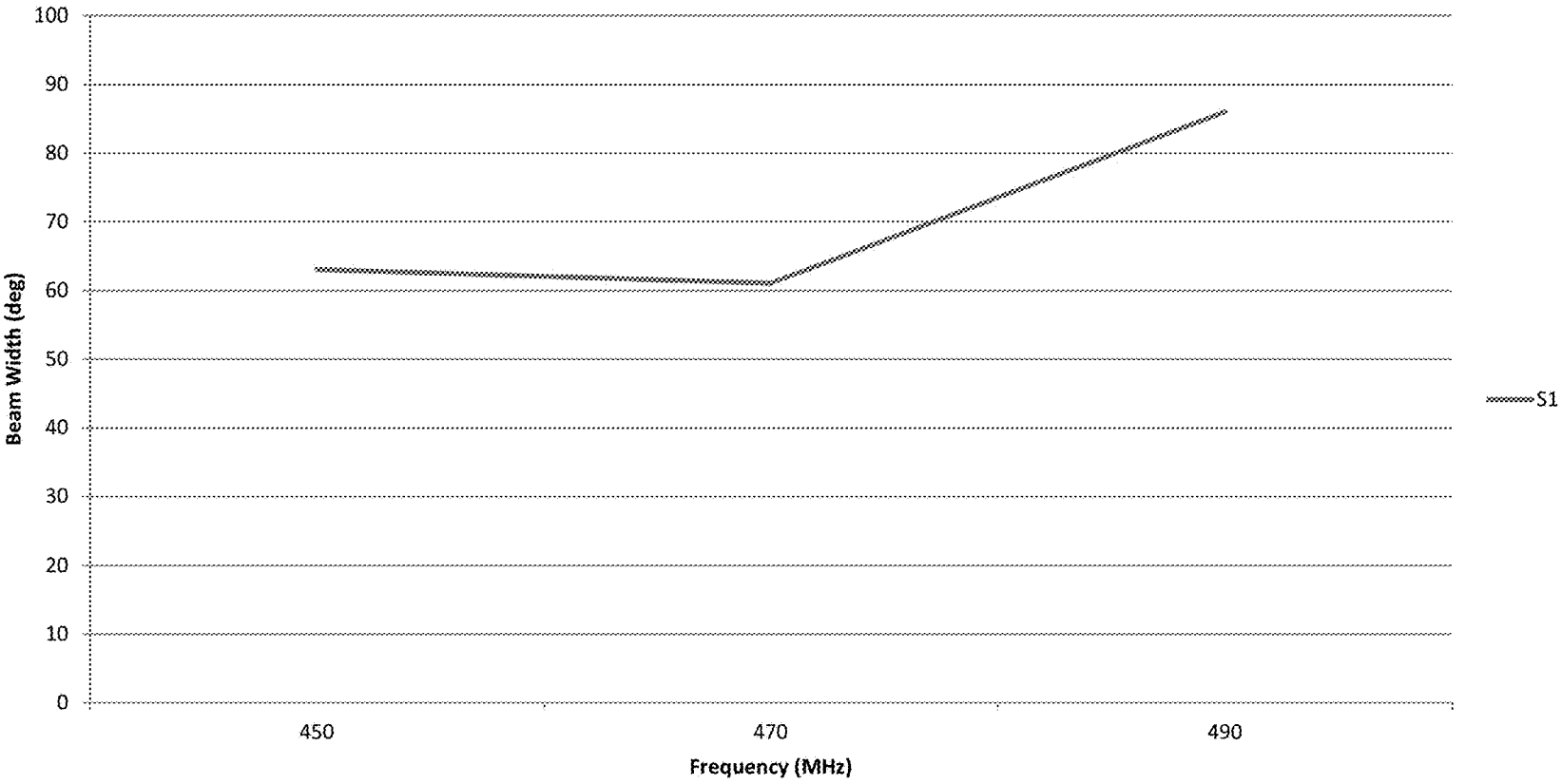
Figure 67:
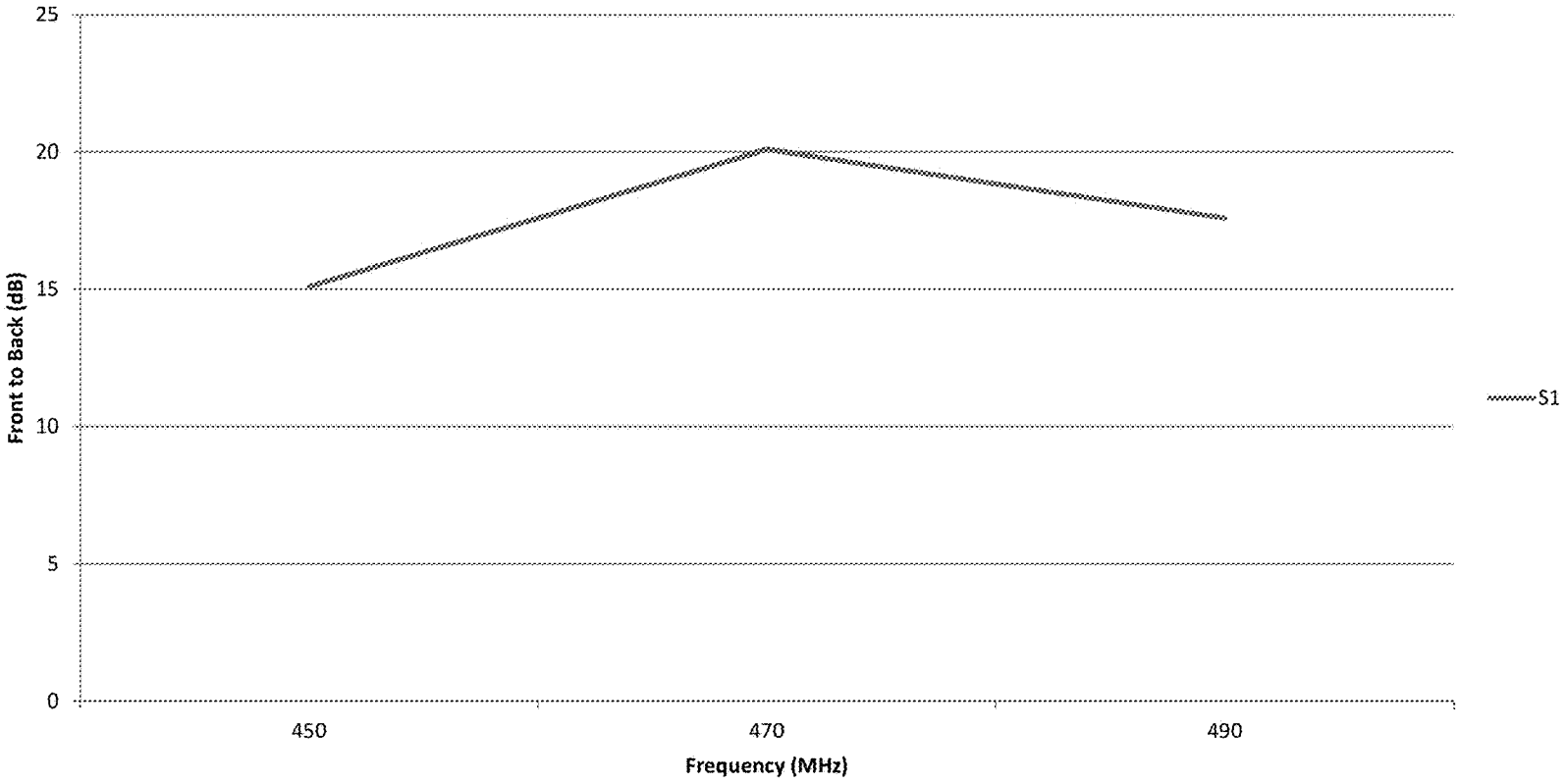

FIG. 66 is an exemplary line graph of Elevation Plane Beam Width in degrees versus frequency from 450 MHz to 490 MHz measured for the larger prototype of the antenna assembly according to the exemplary embodiment shown in FIG. 43; and FIG. 67 is an exemplary line graph of front to back ratio in decibels (dB) versus frequency from 450 MHz to 490 MHz measured for the larger prototype of the antenna assembly according to the exemplary embodiment shown in FIG. 43.

DETAILED DESCRIPTION

Example embodiments will now be described more fully with reference to the accompanying drawings.

Disclosed herein are exemplary embodiments of internally fed directional folded Yagi antenna assemblies. In an exemplary embodiment, an antenna assembly includes a boom (broadly, a support structure), an internally fed cable assembly, and a plurality of dipole elements supported by and spaced along a length of the boom. The dipole elements include a folded dipole element, a reflector dipole element, and director dipole elements. The director dipole elements may be formed or bent so as to have a unique shape, which may allow the antenna patterns to behave symmetrical. The cable assembly is fed internally inside the hollow interior or structure of the boom and a portion of the folded dipole element.

Continuing with this exemplary embodiment, the cable assembly includes a first cable (e.g., coaxial cable, other transmission line, etc.) and a second cable (e.g., coaxial jumper, other feed, etc.). The first cable extends through an open end of the boom and into the hollow interior of the boom. The second cable extends through the hollow interior of a first curved or folded section of the folded dipole element. The first cable includes a first center conductor having first and second end portions. The second cable includes a second center conductor having first and second end portions. The first end portion of the second center conductor is electrically connected to the first end portion of the first center conductor. The second end portion of the second center conductor extends between and across a gap separating end portions of the first and second sections of the folded dipole element.

The folded dipole element generally includes two sections, which are the first section through which the second cable is fed through and the second section to where electrical currents return. The first and second sections of the folded dipole element are aligned thru the center of the boom. A bushing is used to electrically connect the second center conductor of the second cable to the end portion of the second section of the folded dipole element. The bushing may be welded to the end portion of the second section. This configuration preferably creates the same characteristics of a dipole but which is located in the center of the boom as opposed to the side of the boom and also enables the same broadband characteristics of the antenna.

The first and second sections of the folded dipole element may be folded, shaped, or bent so as to taper to the boom, which allows the second cable (broadly, a feed) from the first cable (broadly, a transmission line) to extend through the hollow interior of the first or second section of the folded dipole element. The tapering angle of the first and second sections may be curved or multistep depending on the particular application. Also, this exemplary embodiment does not require the cable to be grounded on an external face of the boom as is required for some conventional externally fed conventional folded Yagi antennas.

In this exemplary embodiment, both open ends of the boom are sealed. A molded insert may be used to seal one end, and the opposite end where the cable exists may be sealed with potted material. The center conductor and insulator of the second cable may be fed inside the first or top section of the folded dipole element after removing the outer braid/tape, if any, from the center conductor. A spring leaf adapter or contact is used for grounding the first cable to the inside walls of the boom. This allows the cable to be fed internally and provide sufficient power handling (e.g., up to 300 Watts, etc.) comparable to a conventional externally fed folded Yagi antenna.

Figure 1:
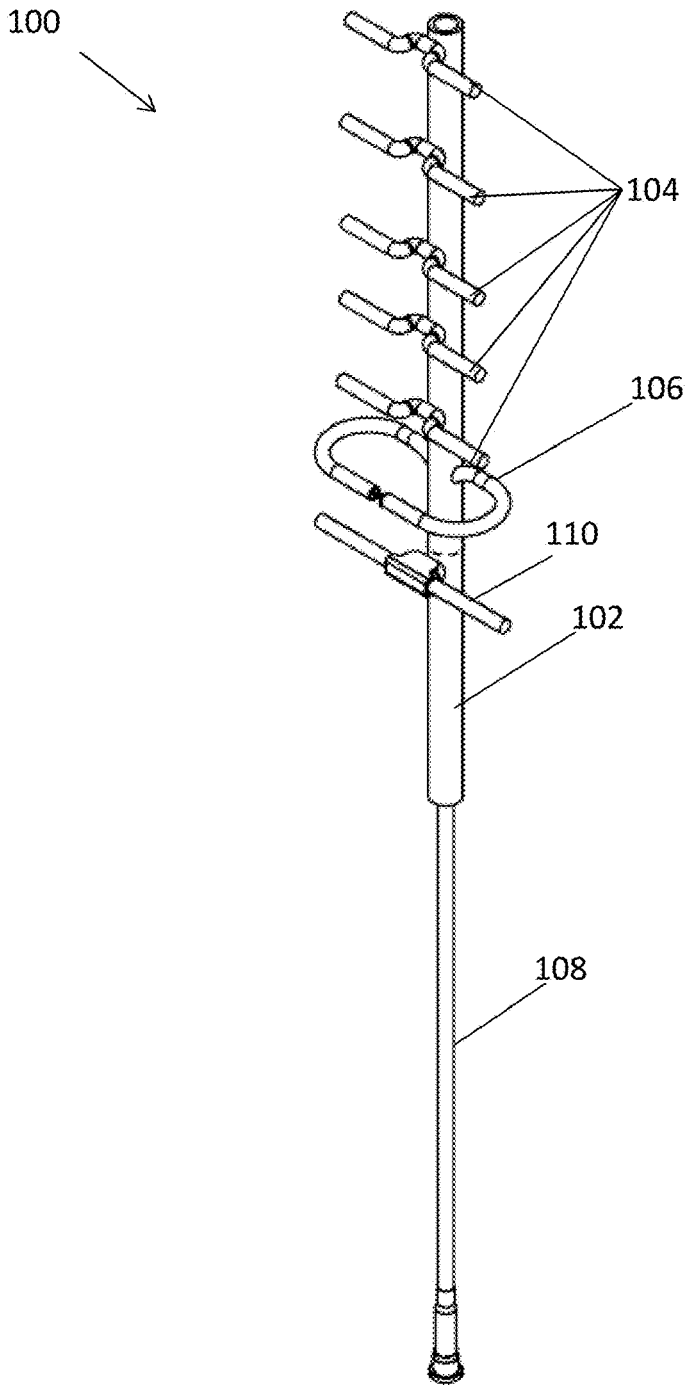
FIG. 1 is a perspective view of an antenna assembly according to an exemplary embodiment.

Referring now to the figures, FIG. 1 illustrates an exemplary embodiment of an antenna assembly 100 embodying one or more aspects of the present disclosure. As disclosed herein, the antenna assembly 100 may also be referred to as a Yagi-Uda antenna or Yagi antenna. The antenna assembly 100 includes a boom 102 (broadly, a support structure) and a plurality of dipole elements spaced apart along a length of the boom 102. The plurality of dipole elements includes director dipole elements 104, a folded dipole element 106, and a reflector dipole element 110. The antenna assembly 100 also includes a first transmission line or cable 108 (e.g., coaxial feed cable, other suitable transmission lines, etc.).

In this exemplary embodiment, the boom 102 is a straight, hollow circular cylinder or tube made of electrically-conductive material (e.g., metal, etc.). Although the boom 102 is shown as a straight tube with a substantially circular cross-section, alternative embodiments may include a boom having other cross-sectional shapes (e.g., ellipses, rectangles, squares, triangles, other non-circular shapes, etc.). The cross-sectional shape and/or size of the boom 102 may depend on the particular type, shape, and/or size of cable or other transmission line that will be fed through the hollow interior of the boom 102.

The director dipole elements 104 are attached to the boom 102, e.g., by welding the middle sections 105 (FIG. 2) of the director dipole elements 104 to the boom 102, etc. The director dipole elements 104 extend or protrude from the boom 102 generally parallel with each other. The folded dipole element 106 is also attached to the boom 102, e.g., by welding end portions of the first and second sections 115, 117 of the folded dipole element 106 to the boom 102, etc. The reflector dipole element 110 is also attached to the boom 102, e.g., by welding a middle section of the reflector dipole element 110 to the boom 102, etc. The reflector dipole element 110 is located on an opposite side of the folded dipole element 106 than the director dipole elements 104. The cable 108 (which may be a coaxial cable or the like) is fed into the hollow body of the boom 102 and inserted into an inner portion of the folded dipole element 106.

Figure 2:
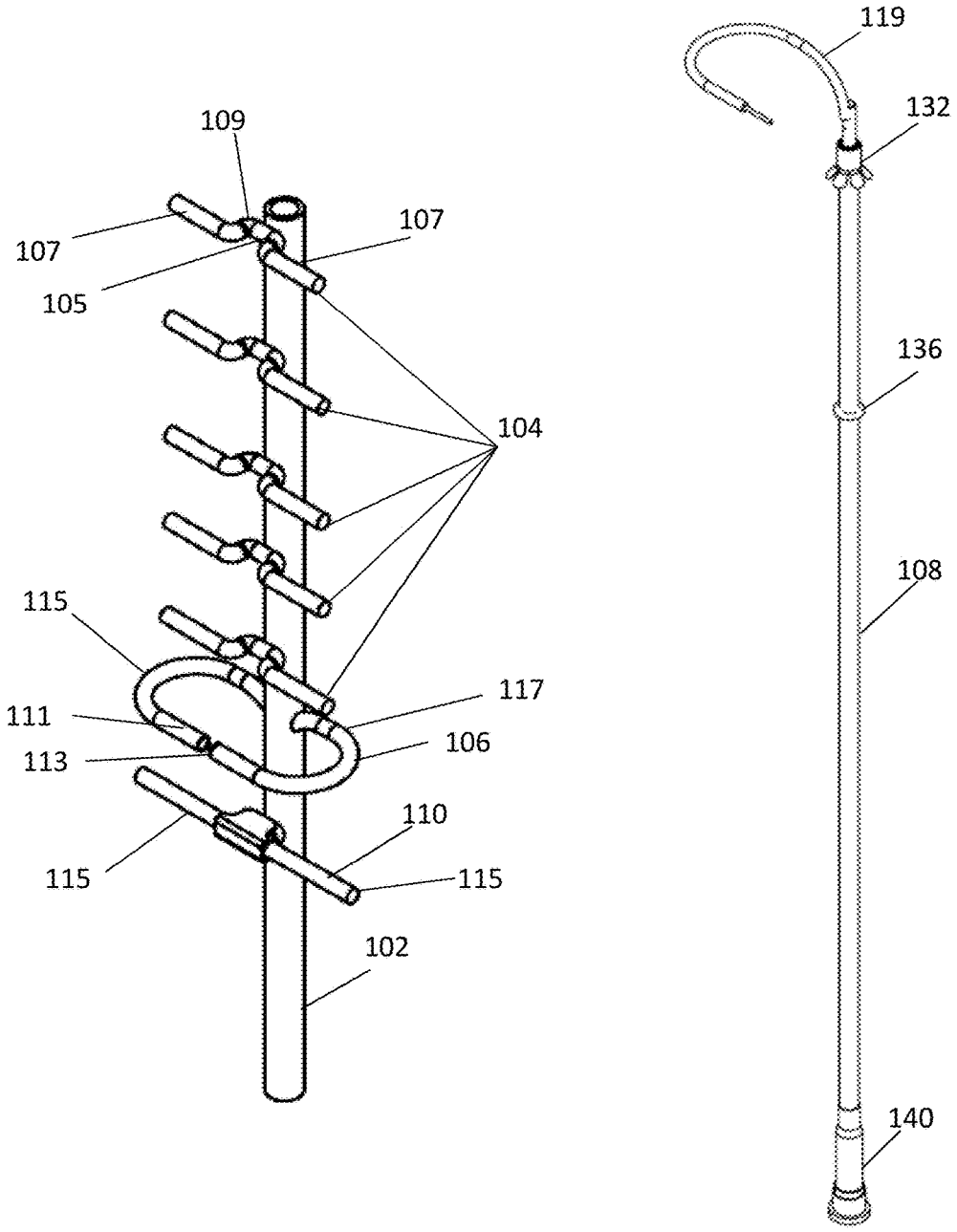
FIG. 2 is a perspective view of the antenna assembly of FIG. 1 showing the first or upper portion (or antenna sub-assembly) that includes dipole elements spaced apart along a boom separate from the second or lower portion (or cable sub-assembly) that includes a first cable (e.g., coaxial feed cable, etc.), grounding elements, and a second cable (e.g., internally fed coaxial jumper, etc.)

In the illustrated embodiment, each director dipole element 104 is formed or bent such that each end portion 107 generally extends or curves away from the middle section 105 of the director dipole element 104 that is attached to the boom 102. Further, each end portion 107 of the director dipole element 104 is then formed or bent again in a substantially opposite direction such that the remainder of the end portion 107 is substantially parallel with the middle section 105 attached to the boom 102. As a result, the end portions 107 of the director dipole elements 110 are parallel and extend above or away from the boom 102 as illustrated in FIG. 2. Each director dipole element 110 thus includes a middle section 105 attached to the boom 102, two generally straight parallel end portions 107, and two (e.g., curved, angled, slanted, etc.) connecting portions 109 that are between the middle section 105 and a corresponding one of the end portions 107. The two connecting portions 109 are not parallel with the middle section 105 or the end portions 107. An angle formed between the connection portions 109 and the middle section 105 may be an acute angle of about 60 degrees, more than 60 degrees, or less than 60 degrees, etc.

As shown in FIG. 2, the folded dipole element 106 is attached to the boom 102 at two points or joints along opposite sides of the boom 102. The joints (e.g., welds, etc.) between the folded dipole element 106 and the boom 102 may be tapered in order to allow the cable 108 to pass from the boom 102 into the folded dipole element 106. The first and second sections 115, 117 of the folded dipole element 106 are formed, bent, or folded generally away from the boom 102. The first and sections 115, 117 of the folded dipole element 106 may be curved (e.g., generally U shaped or C shaped, etc.) or multi-step, which may depend at least partially on aspects and/or limitations of the cable 108. The folded dipole element 106 generally forms an incomplete loop (e.g., partial oval shaped loop, etc.) with the two free end portions 111, 113 of the folded dipole element 106 adjacent and nearly joined. The free end portions 111, 113 of the folded dipole element 106 may be generally parallel to the free end portions 107 of the director dipole elements 105 and the free end portions 115 of the reflector dipole element 102. The end portions 111, 113 of the folded dipole element 106 may be spaced part a greater distance away from the boom 102 than the end portions 107 of the director dipole elements 104 and the end portions 115 of the reflector dipole element 102. The end portions 107 of the director dipole elements 104 and the end portions 115 of the reflector dipole element 102 may align to define a hypothetical plane that passes between the boom 102 and the end portions 111, 113 of the folded dipole element 106.

With continued reference to FIG. 2, the second cable 119 is shown generally curved with a curvature corresponding with or matching the curvature of the hollow interior of the first section 115 of the folded dipole element 106 through which the second cable 119 is fed. The second cable 119 may thus be curved to fit into the hollow interior of the first section 115 of the folded dipole element 106 when the first cable 108 is inserted into the boom 102. The second cable 119 may have a smaller diameter than the first cable 108 in order to fit within the hollow interior of the folded dipole element 106 when the folded dipole element 106 has a smaller diameter than the boom 102.

Figure 3:
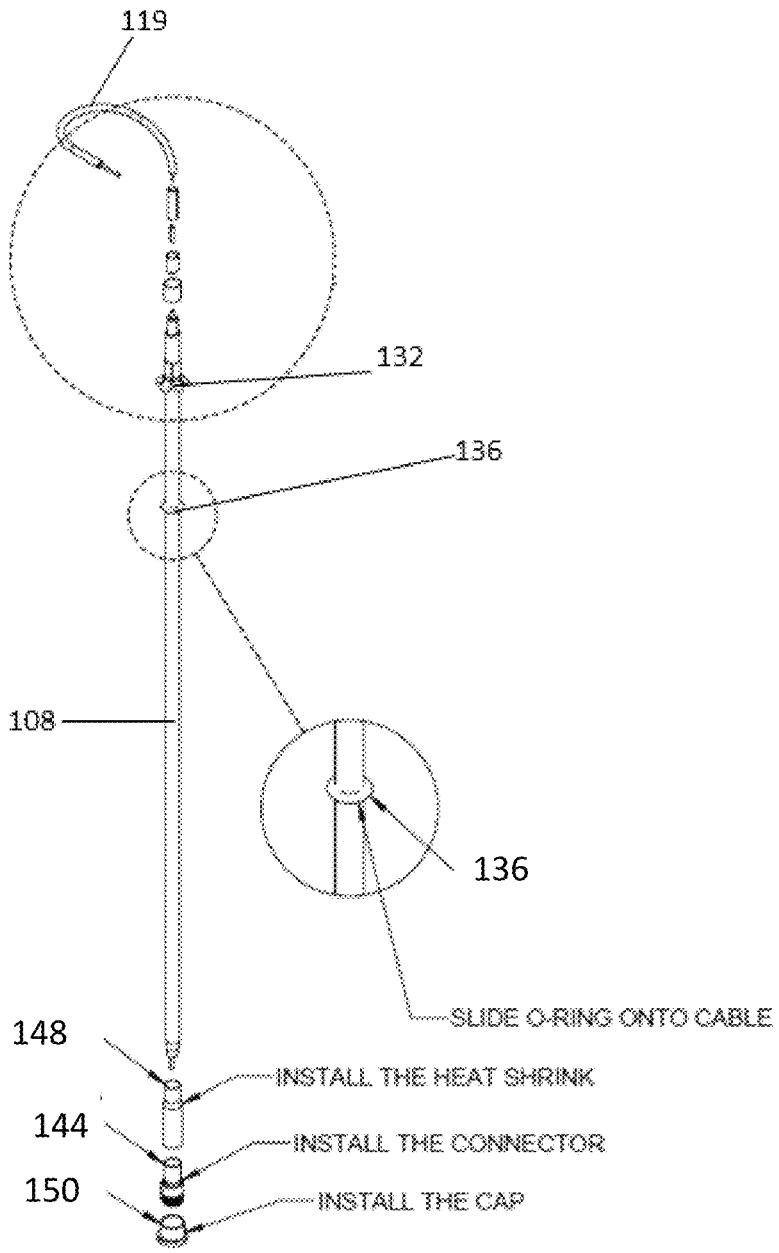
FIG. 3 is an exploded perspective view of the second or lower portion of the antenna assembly shown in FIG. 2.

Also shown in FIG. 2 is a spring leaf contact or grounding part 132, an O-ring 136, and a lower portion 140, which includes a connector 144 as shown in FIG. 3. The spring leaf contact or grounding part 132 is configured such that the leaves of the spring leaf contact 132 contact an inner surface of the boom 102 such that the outer surface of the first cable 108 is grounded to the boom 102 via the contact of the leaves. The spring leaf contact 132 may be made of a resilient electrically-conductive material that allows the leaves to bend or deform when the first cable 108 is inserted into the boom 102 and remain in contact against the inner surface of the boom 102.

As shown in FIG. 2, the O-ring 136 is located on the first cable 108 at a location below the spring leaf contact 132 at which the O-ring 136 will be inserted into the open end of the boom 102 when the first cable 108 is fully inserted into the boom 102. The O-ring 136 is configured to form a seal between an outer surface of the first cable 108 and an inner surface of the boom 102. The seal helps to inhibit the ingress of solid objects and liquid into an inner area of the boom 102 beyond the O-ring 136. The seal may be substantially liquid-tight and/or substantially air-tight. The O-ring 136 may be of a rubber material or other similar compressible dielectric material, which prevents electrical conduction between the cable 108 and boom 102 at the point of the O-ring 136. The material of the O-ring 136 may compress, flex, or deform when the first cable 108 is inserted into the boom 102 such that the O-ring 136 provides an expanding force against the inner surface of the boom 102 and outer surface of the cable 108 to maintain the seal between the inner surface of the boom 102 and the outer surface of the cable 108.

The lower portion 140 includes the connector 144 as shown in FIG. 3. The connector 144 enables the first cable 108 to be connected to other cables and/or ports in order to transmit signals to and from the antenna assembly 100. Also shown in FIG. 3 are a heat shrink 148 and a cap 150. The O-ring 136 may be slid onto and up the cable 108 prior to attaching the heat shrink 148, connector 144, and cap 150. After the O-ring 20 is slid onto the cable 108, the heat shrink 148 and connector 144 may be installed. The cap 150 may then be placed over an end portion of the connector 144. Heat may then be applied to cause shrinkage of the heat shrink 148 to thereby create a seal.

Figure 4:
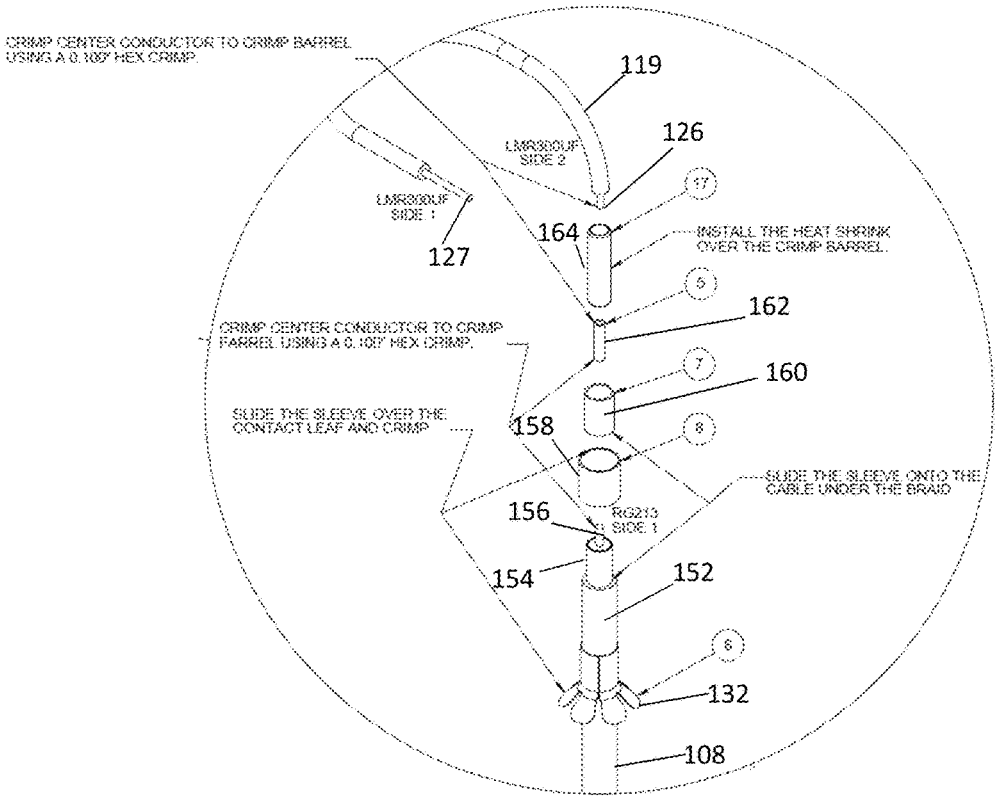
FIG. 4 is a perspective view of the portion of the antenna assembly circled in FIG. 3.

FIG. 4 illustrates various components that may be used for connecting the second cable 119 to the first cable 108. As shown in FIG. 4, the first cable 108 includes a center conductor 156, an electrical insulator or dielectric material 154 around the center conductor 156, and an outer layer 152 (e.g., a cable braid, etc.). The second cable 119 also includes a center conductor having first and second end portions 126, 127. Also shown in FIG. 4 are a crimp sleeve or bushing 158, an inner sleeve or bushing 160, a crimp ferrule or barrel 162, and a heat shrink 164.

The crimp sleeve or bushing 158 is slid or placed over the cable outer layer 152 and spring leaf contact 132 and then crimped to thereby hold the spring leaf contact 132 in place on the first cable 108. The leaves of the spring leaf contact 132 extend outwardly away from the first cable 108, while the crimp sleeve or bushing 158 covers a cylindrical portion of the spring leaf contact 132. The inner sleeve or bushing 160 is slid onto the cable 108 over the dielectric or insulative layer 154 and the center conductor 156 and under the outer layer or cable braid 152.

The crimp ferrule or barrel 162 is positioned on and generally between the end portion of the center conductor 156 of the first cable 108 and to the first end portion 126 of the center conductor of the second cable 119. The crimp ferrule or barrel 162 is then crimped (e.g., using a 0.1 inch hex crimp, etc.) onto both the end portions of the center conductors 156 and 126, thereby forming an electrical connection between the center conductors 156, 126 of the first and second cables 108, 119, respectively. The heat shrink 164 is installed over the crimp ferrule or barrel 162. Heat may then be applied to cause shrinkage of the heat shrink 164 to thereby help retain the crimp ferrule or barrel 162 in place and maintain the electrical connection between the center conductor end portions 156, 126 of the first and second cables 108, 119, respectively.

Figure 8:
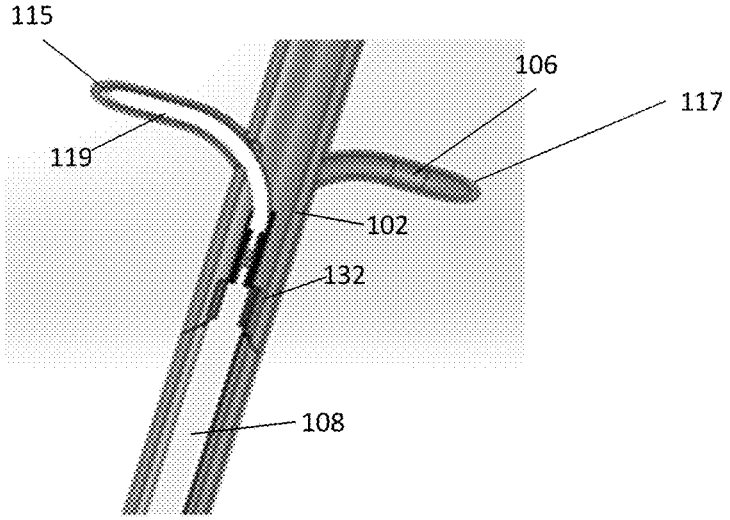
FIG. 8 is a cross-sectional perspective view of the boom and folded dipole element of the antenna assembly shown in FIG. 1, and illustrating the electrical connection between the first and second cables within the hollow interior of the boom and also illustrating the second cable internally fed through a hollow interior of a first portion or section of the folded dipole element.
Figure 9:
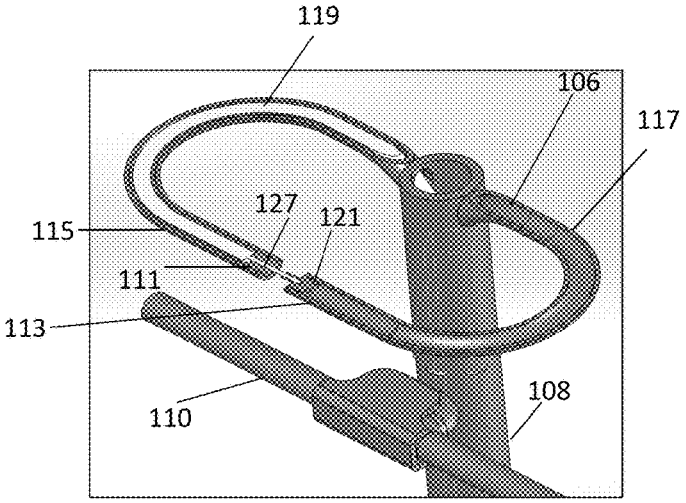
FIG. 9 is another cross-sectional perspective view of the boom and folded dipole element of the antenna assembly shown in FIG. 1, and illustrating the second cable internally fed through the hollow interior of the first portion of the folded dipole element, and the center conductor of the second cable extending between and across the gap separating the end portions of the folded dipole element.

Referring now to FIGS. 5 through 9, the first and second sections 115, 117 of the folded dipole element 106 are shown extending or protruding from opposite sides of the boom 102. The first and second sections 115, 117 are folded, formed, or bent around and toward each other to form an incomplete loop. As shown in FIGS. 5, 6, and 9, there is a gap between the end portions 111, 113 of the first and second sections 115 and 117 of the folded dipole element 106. Although the second cable 119 may be inserted through either the first or second section 115 or 117, FIGS. 8 and 9 show the second cable 119 inserted and extending through the first section 117. The second cable 119 may end near the gap between the end portions 111, 113 of the folded dipole sections 115, 117.

As shown in FIGS. 6 and 9, the end portion 127 of the center conductor of the second cable 119 extends out of the first section 115 into the gap between the first and second sections 115 and 117. The center conductor end portion 127 may be inserted into a crimp bushing 121 (FIG. 9), which is within the end portion of the second dipole section 117. The crimp bushing 121 may be crimped to thereby help retain center conductor end portion 127 in place and maintain or secure the electrical connection between the center conductor and the second section 117 of the folded dipole element 106. With the center conductor of the second cable 119 attached to the second section 117 of the folded dipole element 106, dipole characteristics may thus be created at the center of the boom 102 rather than at the side of the boom 102.

Before the center conductor of the second cable 119 is inserted into the crimp bushing 121, a heat shrink 123 (FIG. 6) may be positioned onto the folded dipole element 106 through the gap between the first and second sections 115, 117 of the folded dipole element 106. The heat shrink 123 may then be moved out of the way onto the first or section 115, 117. A rubber tube 125 may be positioned onto the folded dipole element 106 through the gap and then moved out of the way onto the first or section 115, 117. The center conductor end portion 127 of the second cable 119 may then be inserted into the crimp bushing 121. The rubber tube 125 and heat shrink 123 may then be moved into place over the gap aligned to the center of the boom 102 as shown in FIG. 7. Heat may then be applied to cause shrinkage of the heat shrink 123 to thereby help retain the crimp bushing 121 in place and maintain the electrical connection between the center conductor end portion 127 and the second section 117 of the folded dipole element 106. The rubber tube 125 may help protect the center conductor from obstructions and help prevent water ingression.

FIG. 8 shows the first cable 108 extending inside the boom 102, the second cable 119 extending into one side of the folded dipole element 106, and the electrical connection between the first and second cables 108, 119. FIG. 8 also shows the spring leaf contact 132 in contact with an inner surface of the boom 102.

Figure 10:
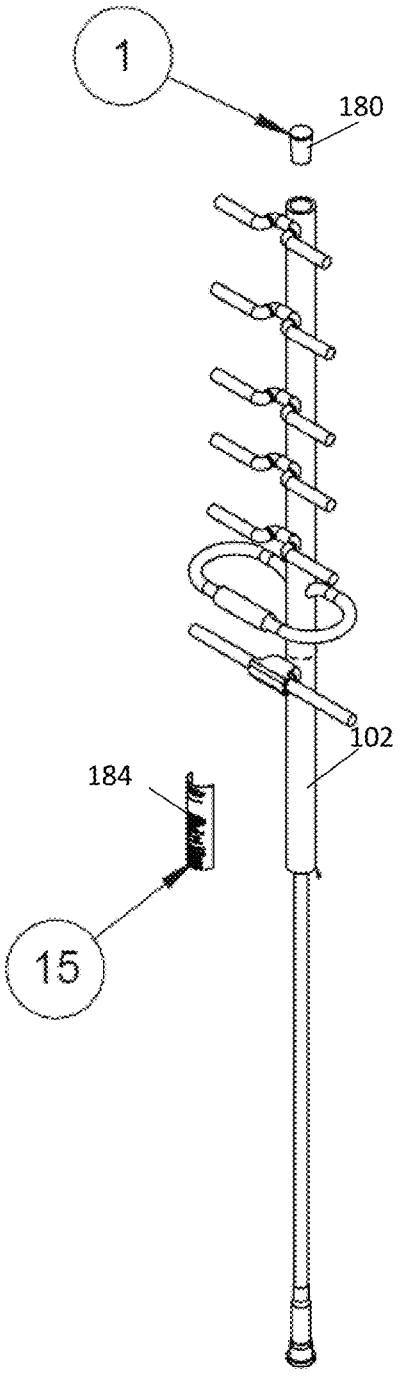
FIG. 10 is a perspective view of the antenna assembly shown in FIG. 7 and also showing an exemplary label and sealing member or element (e.g., rubber plug, molded insert, etc.) aligned for positioning within an open end portion of the boom.
Figure 11:
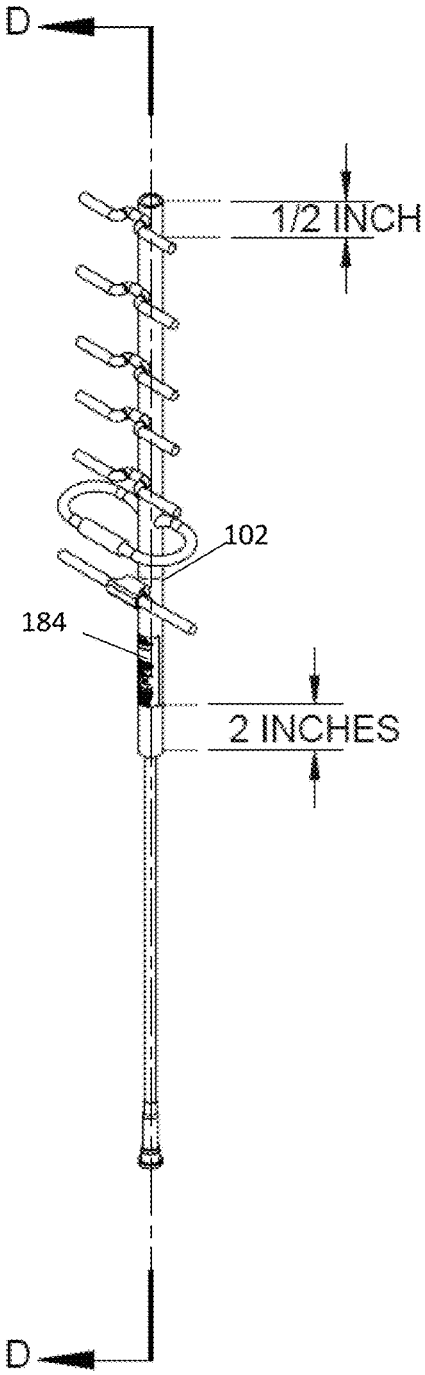
FIG. 11 is a perspective view of the antenna assembly shown in FIG. 10 after the label has been applied along an exterior surface of the boom, and also showing exemplary dimensions in inches for purpose of illustration only.

Referring now to FIGS. 10 and 11, the antenna assembly 100 may also include a rubber plug 180 and a label 184. The rubber plug 180 is inserted into the open end of the boom 102 opposite the first cable 108 in order to prevent foreign objects and/or liquid from entering the interior of the boom 102. The rubber plug 180 may form a water-tight and/or air-tight seal with the boom 102. In this exemplary embodiment, the sealing element is a rubber plug 180. But alternative embodiments may include alternative methods of plugging or sealing the end portion of the boom 102 (e.g., potting material, adhesive material, plastic, soldered material, welded material, a molded insert, etc.).

The label 184 may be attached to the boom 102 via an adhesive material or the like. The label 184 may provide information about the antenna assembly to a person and/or device capable of reading the label 184. The information on the label may include operating frequencies, manufacturer, part number, date code (build date), safety warnings, other specifications of the antenna assembly 100, limitations of the antenna assembly 100, etc.

FIG. 11 shows that, in some exemplary embodiments, the rubber plug 180 is inserted substantially one half inch into the open end of the boom 102. FIG. 11 also shows that label 184 may be attached to the outside of the boom 102 substantially 2 inches from the cable end of the boom 102. The dimensions provided in this paragraph (and elsewhere) are for purposes of illustration only as other exemplary embodiments may be configured with other dimensions.

Figure 12:
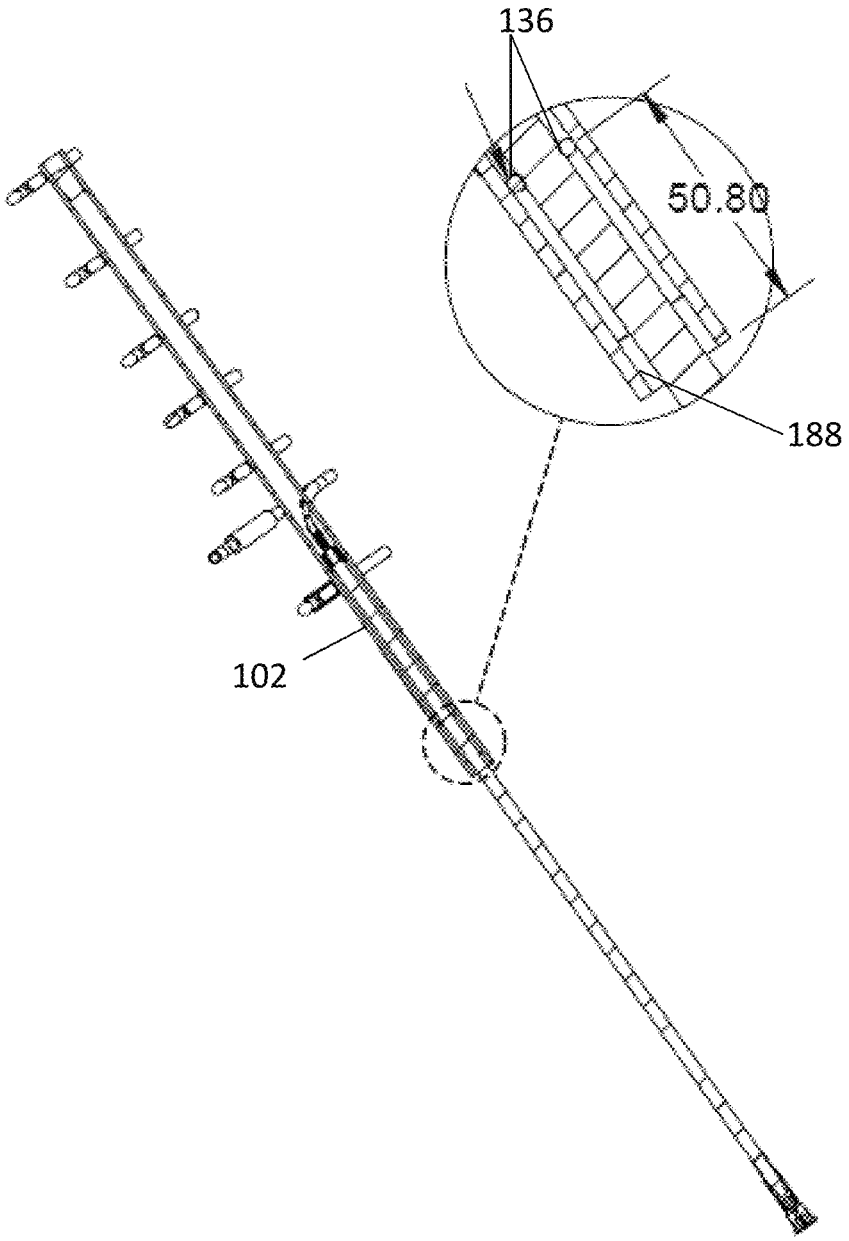
FIG. 12 is a cross-sectional view of the antenna assembly shown in FIG. 10 with exemplary dimensions in millimeters provided for purpose of illustration only.

As shown in FIG. 12, the O-ring 136 may be inserted 50.8 mm (2 inches) into the cable end of the boom 102 to form the seal previously described. Further, a potting material 188 (e.g., thermo-setting plastics, silicone rubber gels, epoxy, etc.) may be inserted into the boom 102 to further enhance the seal. In some exemplary embodiments, the antenna assembly 100 may be sealed such that the antenna assembly 100 satisfies the IP67 ingress protection standard where 6 indicates total protection against solid objects/dust and 7 indicates protection against liquids up to and including the effects of immersion in 15 centimeters to 1 meter of liquid.

Figure 13:
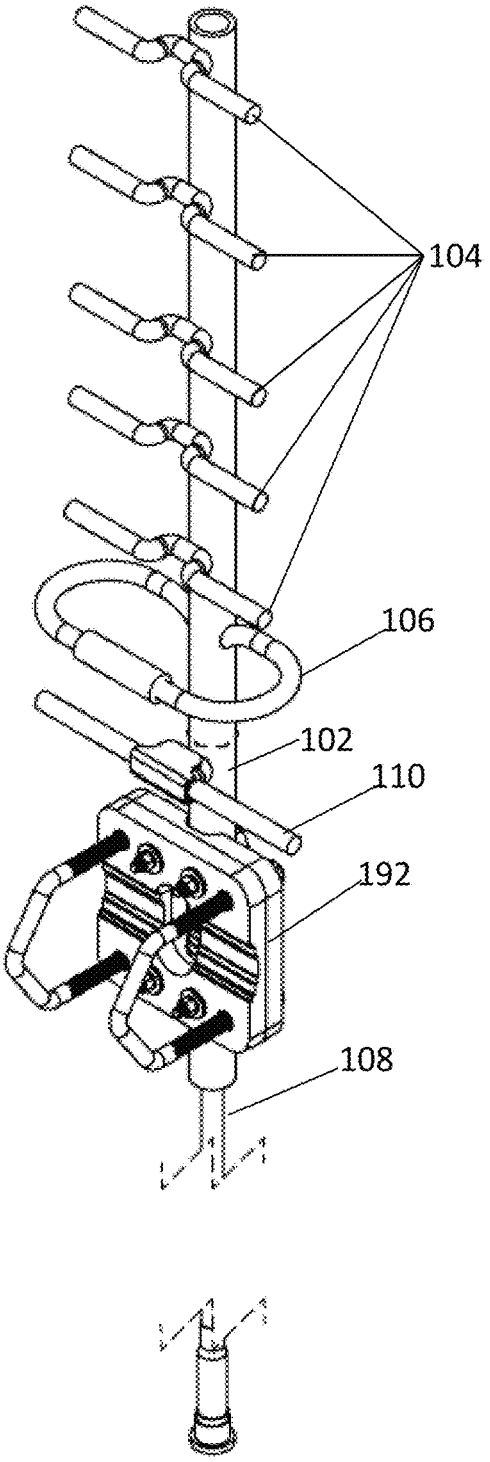
FIG. 13 is a perspective view of the antenna assembly shown in FIG. 7, and further showing an exemplary mounting bracket that may be used for mounting the antenna assembly to a supporting structure or surface.
Figure 14:
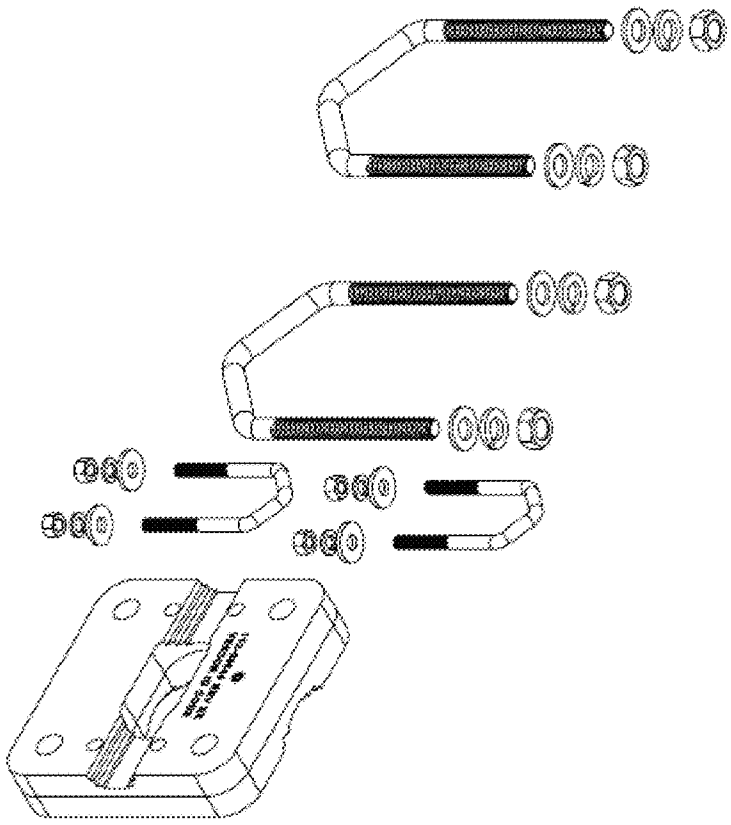
FIG. 14 is an exploded perspective view showing the exemplary mounting bracket shown in FIG. 13 that may be used for mounting the antenna assembly to a supporting structure or surface.

FIGS. 13 and 14 show an exemplary mounting bracket 192 that may be used for mounting the antenna assembly 100 to a supporting structure or surface. In this exemplary embodiment, the mounting bracket 192 may be used to mount or hold the antenna assembly 100 securely to a structure, e.g., having an outside diameter of 2.5 or less, etc.

Figure 15:
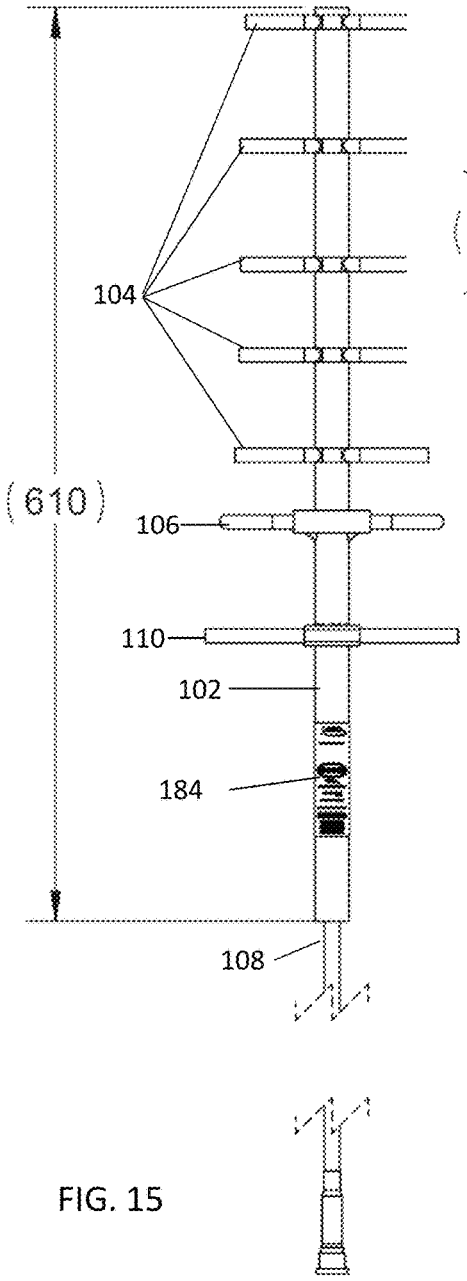
FIG. 15 is a front view of the antenna assembly shown in FIG. 11 with exemplary dimensions in millimeters provided for purpose of illustration only.
Figure 17:
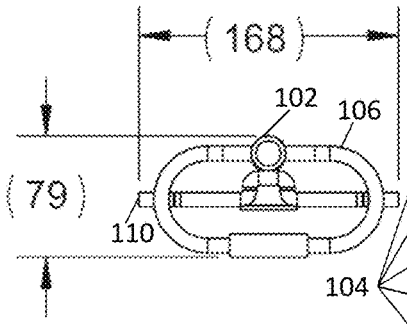
FIG. 17 is a bottom view showing the folded dipole element and reflector dipole element of the antenna assembly shown in FIG. 14 with exemplary dimensions in millimeters provided for purpose of illustration only.
Figure 16:
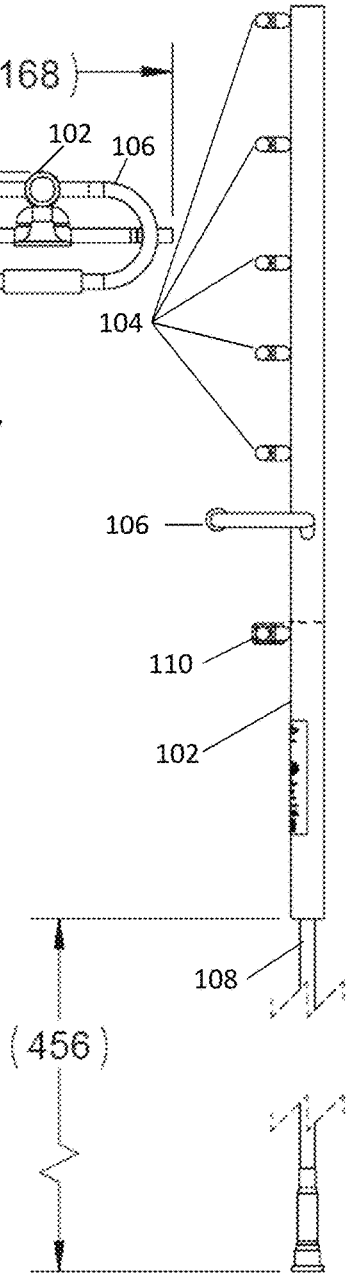
FIG. 16 is a side view of the antenna assembly shown in FIG. 14 with exemplary dimensions in millimeters provided for purpose of illustration only.
Figure 18:
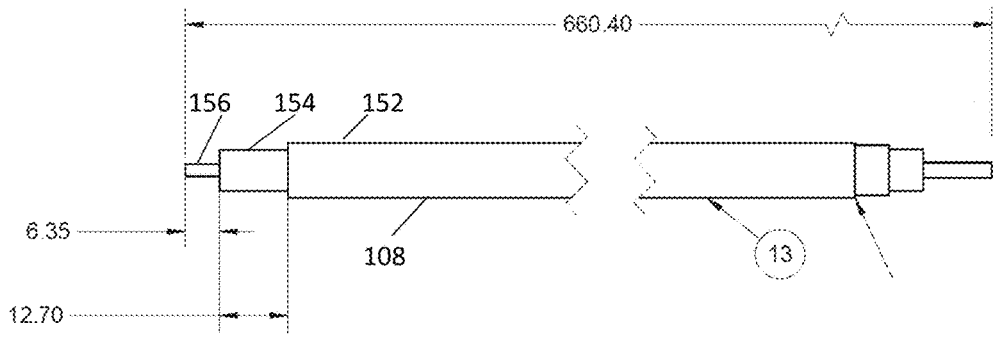
FIG. 18 is a side view of the first cable of the antenna assembly that is internally fed through a hollow interior of the boom for electrical connection with the second cable as shown in FIG. 8, where exemplary dimensions in millimeters are provided for purpose of illustration only.
Figure 19:
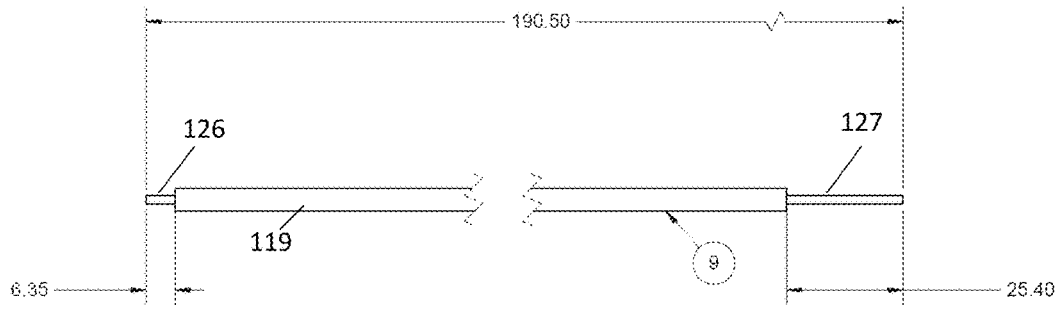
FIG. 19 is a side view of the second cable that is internally fed through the hollow interior of the first portion of the folded dipole element, and also illustrating the center conductor that extends between and across the gap separating the end portions of the folded dipole element as shown in FIG. 9, where exemplary dimensions in millimeters are provided for purpose of illustration only.

FIGS. 15 through 19 provide exemplary dimensions of portions of the antenna assembly 100. The dimensions, sizes, and/or proportions may affect the performance of the antenna assembly 100 and determine, for instance, a range of frequencies that the antenna assembly 100 can reliably receive. For example, FIGS. 15 through 19 provide example dimensions for an antenna assembly attuned to frequencies in the range of 890 MHz to 960 MHz. As shown in FIG. 15, the boom 102 may have a length of 610 mm. FIG. 16 shows that the portion of the cable 108 that extends from the boom 102 may have a length of 456 mm. FIG. 17 shows that the director dipole element 110 may have a width of 168 mm, and the folded dipole element 106 may have a height of 79 mm in FIG. 16. FIG. 18 shows that the first cable 108 may have a total length of 660.40 mm, an inner layer 154 extending from the outer layer 152 may have a length of 12.70 mm, and the center conductor 156 extending from the inner layer 154 may have a length of 6.35 mm. FIG. 19 shows that the second cable 119 may have a length of 190.50 mm. FIG. 19 also shows that the center conductor of the second cable 119 may have a first end portion 126 having a length of 6.35 mm and a second end portion 127 having a length of 25.40 mm. In this example, the antenna assembly 100 may be further configured to have a peak gain of 12 dBi, a vertical or horizontal polarization, a directional radiation pattern, a VSWR less than 1.5 for frequencies from about 890 MHz to about 960 MHz, a power rating of about 200 Watts, IP67 outdoor rating, an operating temperature from about −40 degrees Celsius to about 85 degrees Celsius, a front to back ratio of about 20 decibels (dB), an N-female type connector or termination, an RG213 cable type, and/or a 50 ohm TYP. Impedance. The dimensions and parameters provided in this paragraph (and elsewhere) are for purposes of illustration only as other exemplary embodiments may be configured with other dimensions. For example, an antenna assembly attuned to other frequencies (e.g., from about 450 MHz to about 490 MHz, etc.) may have different dimensions, e.g., smaller for higher frequencies, larger for lower frequencies, etc.

FIGS. 20 through 31 provide results measured for a prototype of the antenna assembly 100 shown in FIG. 7 and having the following performance characteristics: operating frequency range from about 890 MHz to about 960 MHz, VSWR max of 1.6:1, maximum gain of about 12.1 or 12.2 dBi, typical gain of about 7.6 or 7.7 dBi, Azimuth Co-Polar Beam Width of about 54 degrees, Elevation Co-Polar Beam Width of about 47 degrees, Azimuth Co-Polar First Side lobe of about −21 or −25, Elevation Co-Polar First Side lobe of about −24 or −25, front to back ratio of about 22.7 dB, directional antenna type, female type N connector type, and vertical polarization. These analysis results are provided only for purposes of illustration and not for purposes of limitation as other exemplary embodiments may be configured differently and/or have different performance.

Figure 20:
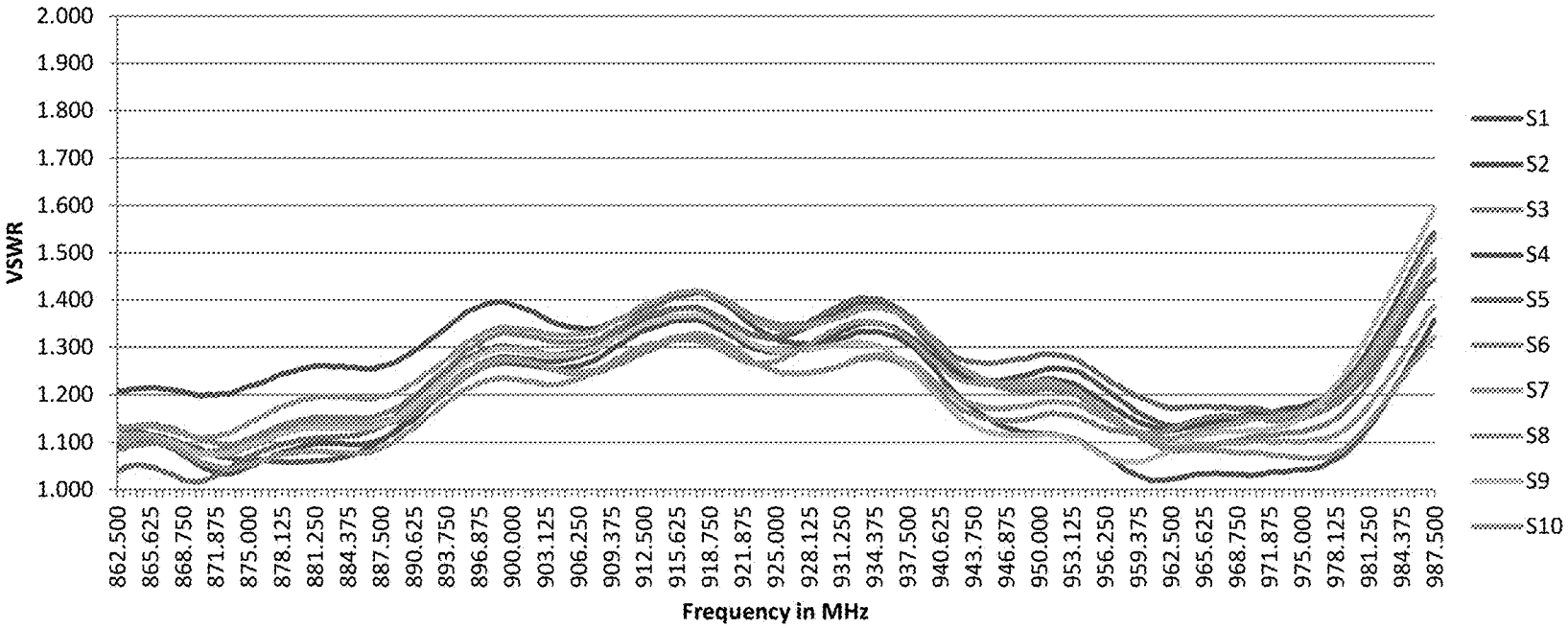
FIG. 20 is an exemplary line graph of voltage standing wave ratio (VSWR) versus frequency in megahertz (MHz) measured for a prototype of the antenna assembly according to the exemplary embodiment shown in FIG. 7.
Figure 21:
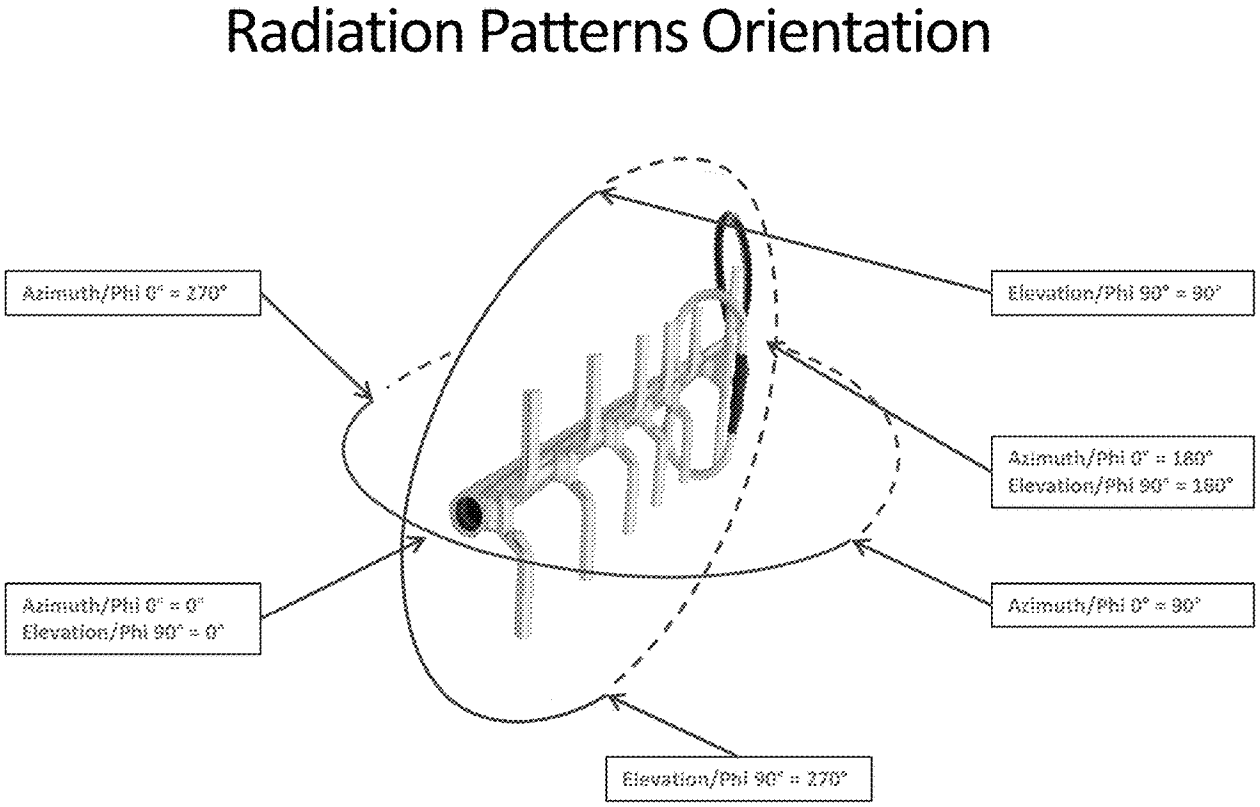
FIG. 21 illustrates the radiation patterns orientation for the antenna assembly according to the exemplary embodiment shown in FIG. 7.
Figure 22:
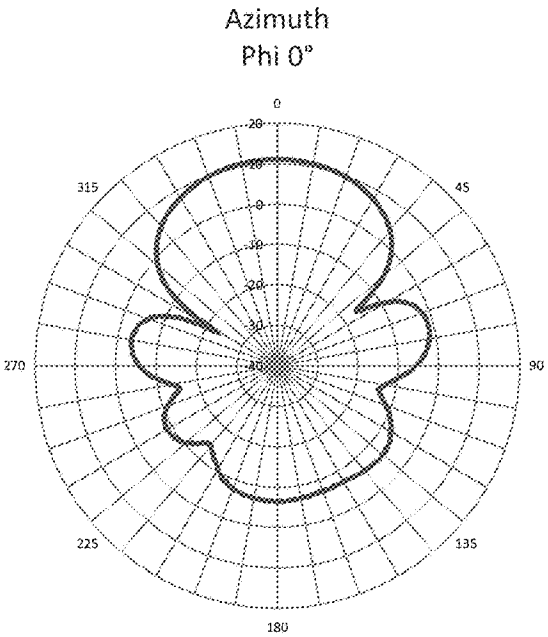
FIGS. 22 through 27 illustrates radiation patterns respectively for Azimuth Plane Phi=0° and Elevation Plane Phi=90° at a frequencies of 890 MHz, 925 MHz, and 960 MHz measured for a prototype of the antenna assembly shown in FIG. 7.
Figure 23:
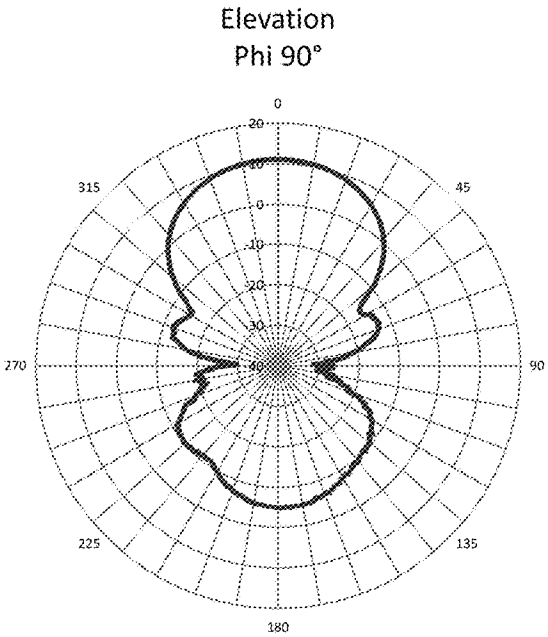
Figure 24:
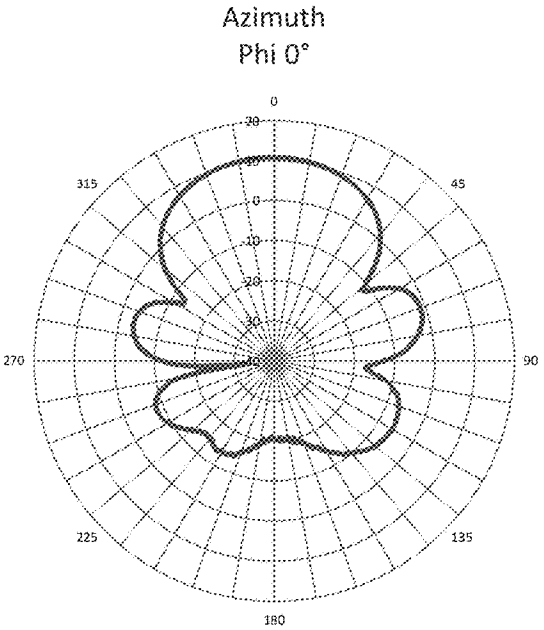
Figure 25:
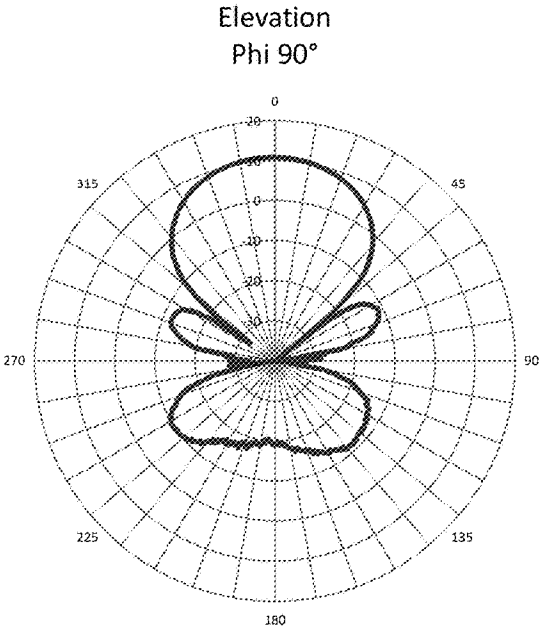
Figure 26:
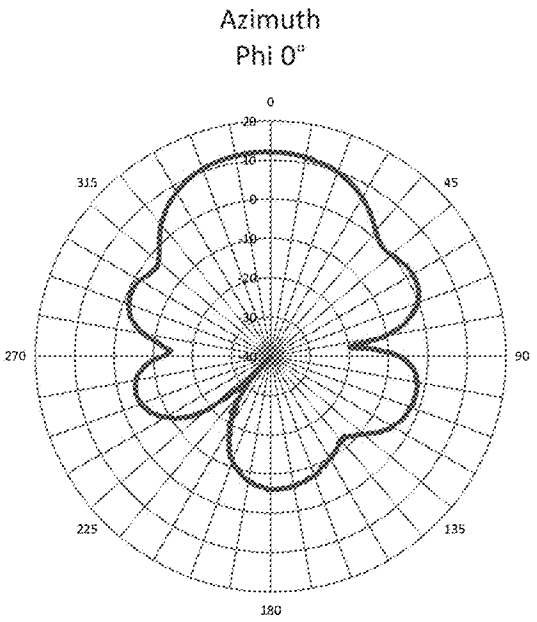
Figure 27:
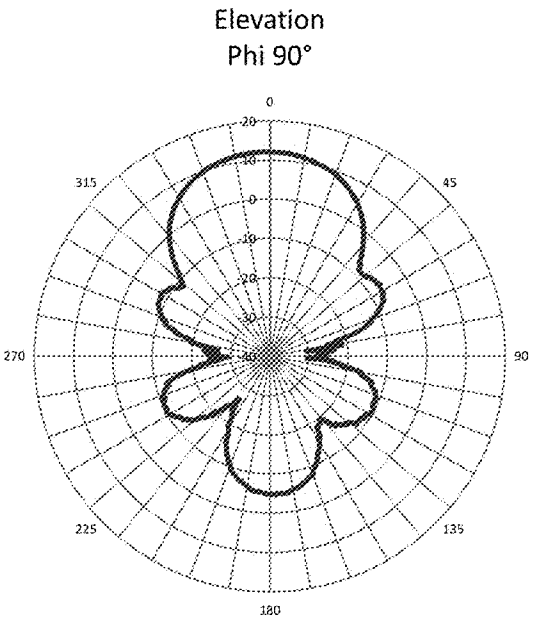

More specifically, FIG. 20 is an exemplary line graph of the voltage standing wave ratio (VSWR) versus frequency in megahertz (MHz) measured for a prototype of the antenna assembly 100 shown in FIG. 7. Generally, FIG. 20 shows the S parameters S1 through S10 for the prototype antenna assembly. FIG. 20 also shows that the prototype antenna assembly had good VSWR less than 1.5 for frequencies between about 862.5 MHz to about 984 MHz.

FIGS. 22 through 27 illustrates radiation patterns respectively for Azimuth Plane Phi=0° and Elevation Plane Phi=90° at a frequencies of 890 MHz, 925 MHz, and 960 MHz measured for a prototype of the antenna assembly 100 shown in FIG. 7. Generally, FIGS. 22 through 27 show that the radiation patterns of the antenna assembly are directional.

Figure 28:
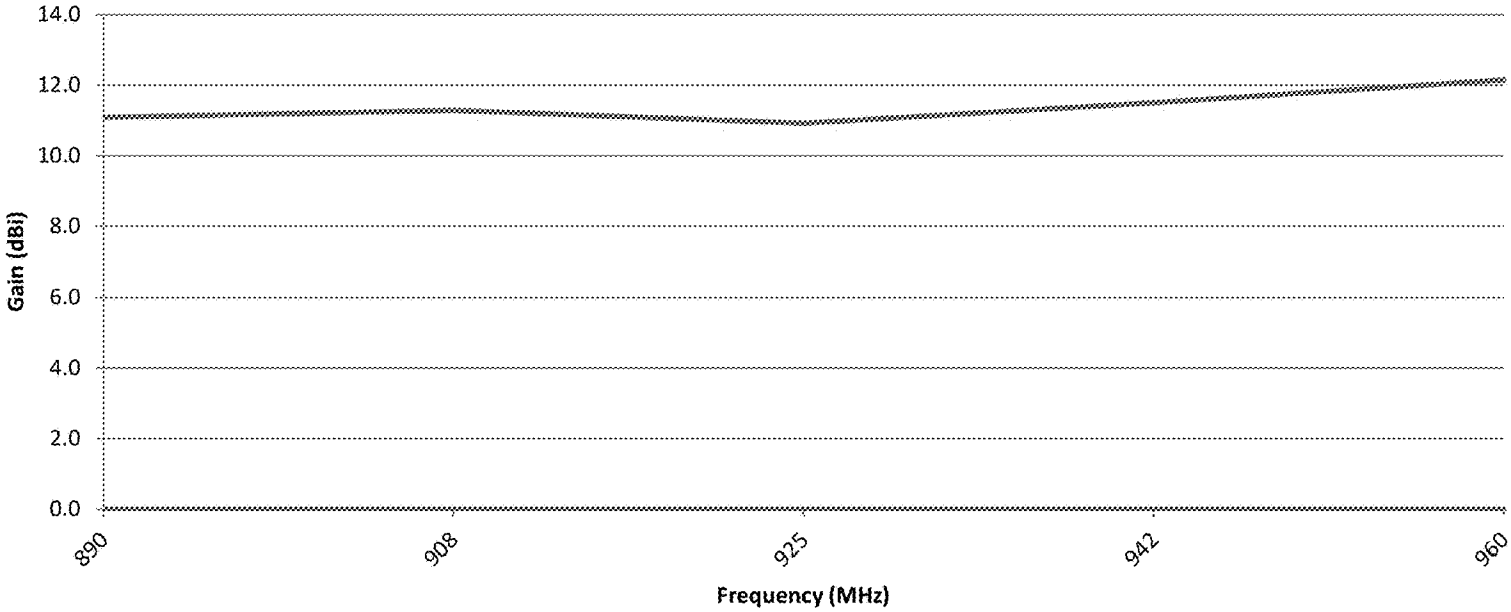
FIG. 28 is an exemplary line graph of gain in decibels relative to isotropic (dBi) versus frequency from 890 MHz to 960 MHz measured for a prototype of the antenna assembly according to the exemplary embodiment shown in FIG. 7.

FIG. 28 is an exemplary line graph of gain in decibels relative to isotropic (dBi) versus frequency from 890 MHz to 960 MHz measured for a prototype of the antenna assembly 100 shown in FIG. 7. Generally, FIG. 28 shows a peak gain of about 12.2 dBi.

Figure 29:
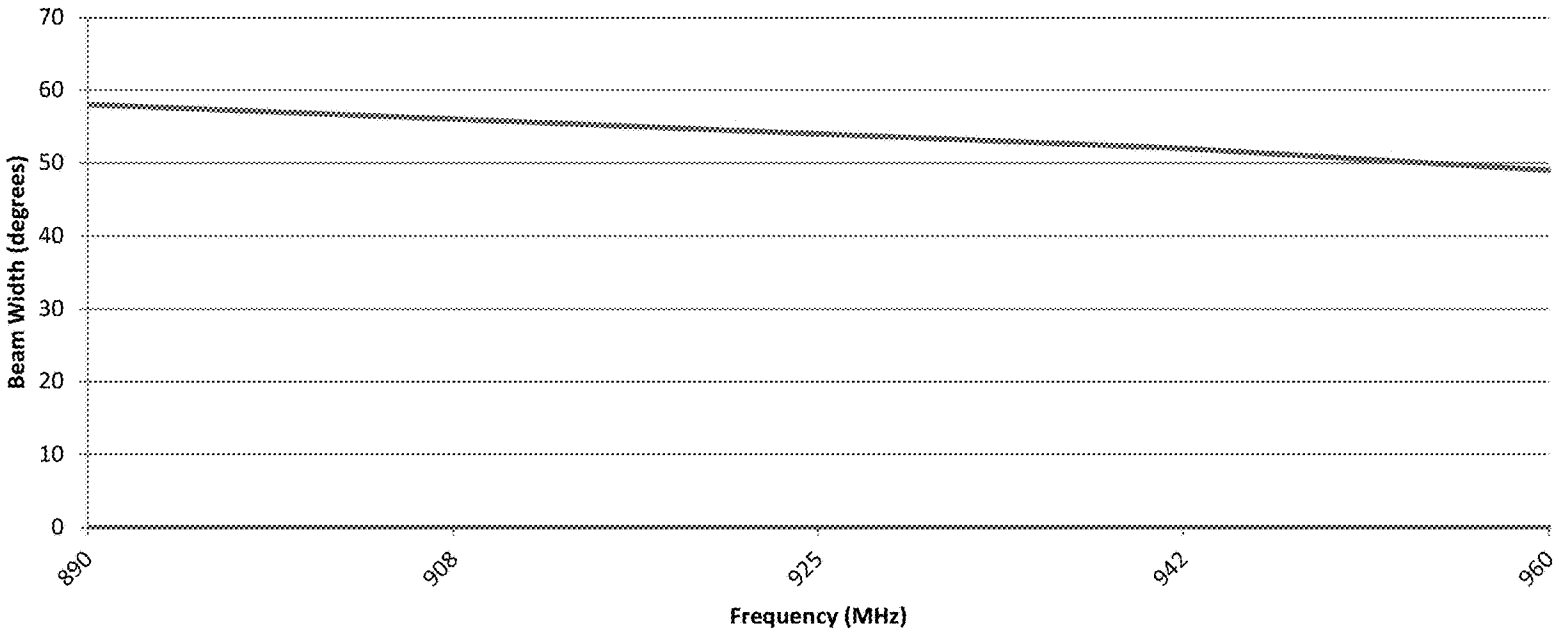
FIG. 29 is an exemplary line graph of Azimuth Plane Beam Width in degrees versus frequency from 890 MHz to 960 MHz measured for a prototype of the antenna assembly according to the exemplary embodiment shown in FIG. 7.
Figure 30:
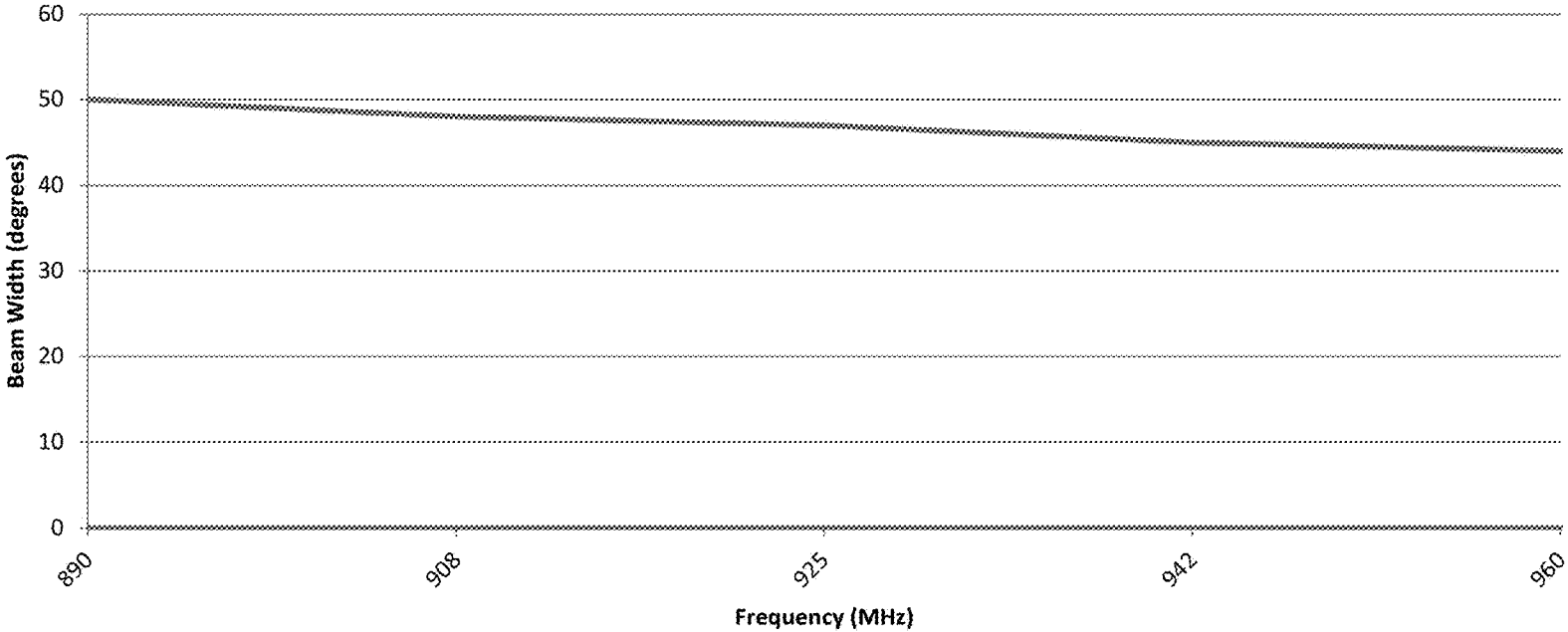
FIG. 30 is an exemplary line graph of Elevation Plane Beam Width in degrees versus frequency from 890 MHz to 960 MHz measured for a prototype of the antenna assembly according to the exemplary embodiment shown in FIG. 7.
Figure 31:
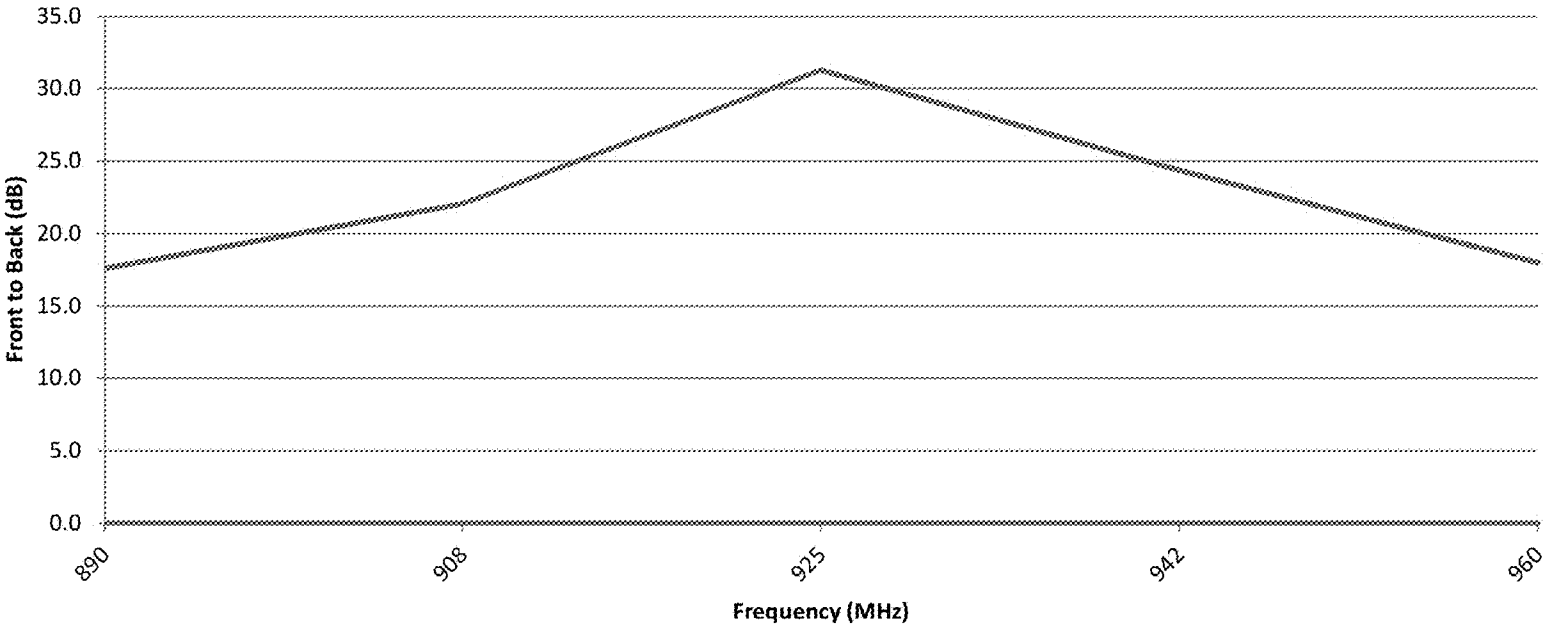
FIG. 31 is an exemplary line graph of front to back ratio in decibels (dB) versus frequency from 890 MHz to 960 MHz measured for a prototype of the antenna assembly according to the exemplary embodiment shown in FIG. 7.

FIG. 29 is an exemplary line graph of Azimuth Plane Beam Width in degrees versus frequency from 890 MHz to 960 MHz measured for a prototype of the antenna assembly 100 shown in FIG. 7. FIG. 30 is an exemplary line graph of Elevation Plane Beam Width in degrees versus frequency from 890 MHz to 960 MHz measured for a prototype of the antenna assembly 100 shown in FIG. 7. FIG. 31 is an exemplary line graph of front to back ratio in decibels (dB) versus frequency from 890 MHz to 960 MHz measured for a prototype of the antenna assembly 100 shown in FIG. 7.

FIGS. 32 through 42 provide results measured for a larger prototype of the antenna assembly 100 shown in FIG. 7 and having the following performance characteristics: operating frequency range from about 450 MHz to about 490 MHz, VSWR max of 1.7:1, maximum gain of about 12.8 dBi, typical gain of about 11.8 dBi, Azimuth Co-Polar Beam Width of about 56 degrees, Elevation Co-Polar Beam Width of about 46 degrees, front to back ratio of about 23.5 dB, directional antenna type, female type N connector type, and vertical or horizontal polarization. These analysis results are provided only for purposes of illustration and not for purposes of limitation as other exemplary embodiments may be configured differently and/or have different performance.

Figure 32:
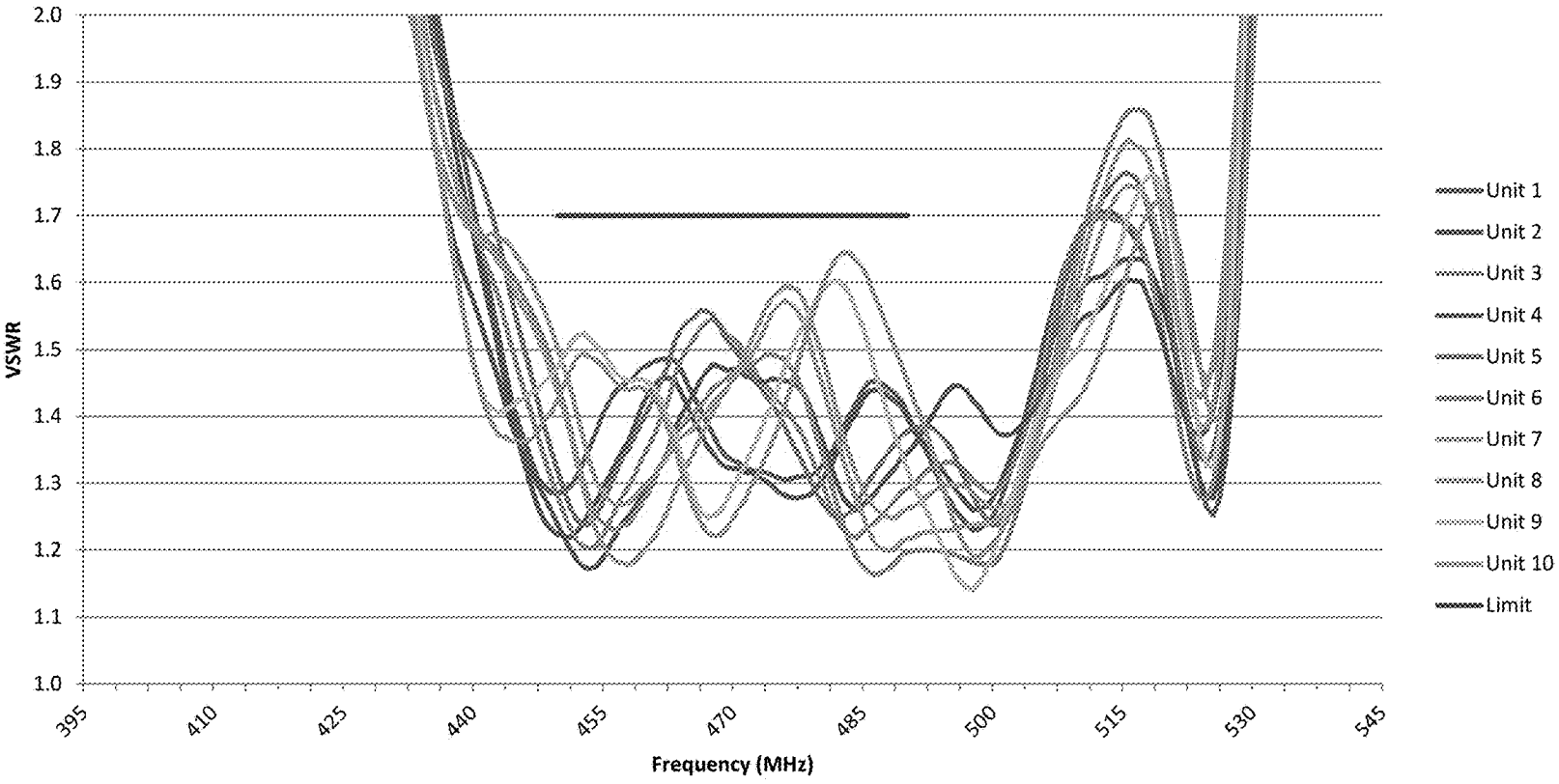
FIG. 32 is an exemplary line graph of voltage standing wave ratio (VSWR) versus frequency in megahertz (MHz) measured for a larger prototype of the antenna assembly according to the exemplary embodiment shown in FIG. 7.
Figure 34:
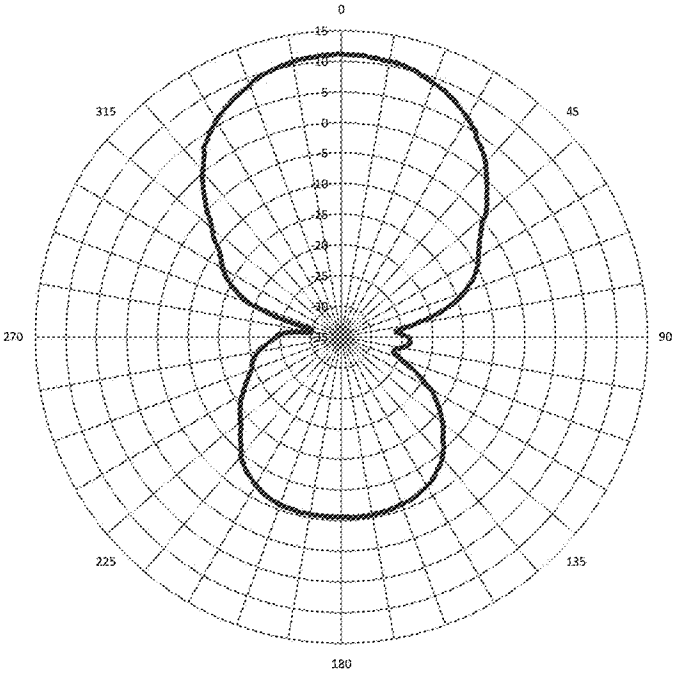
FIGS. 33 through 38 illustrates radiation patterns respectively for Azimuth Plane Phi=0° and Elevation Plane Phi=90° at a frequencies of 450 MHz, 470 MHz, and 490 MHz measured for the larger prototype of the antenna assembly shown in FIG. 7.
Figure 33:
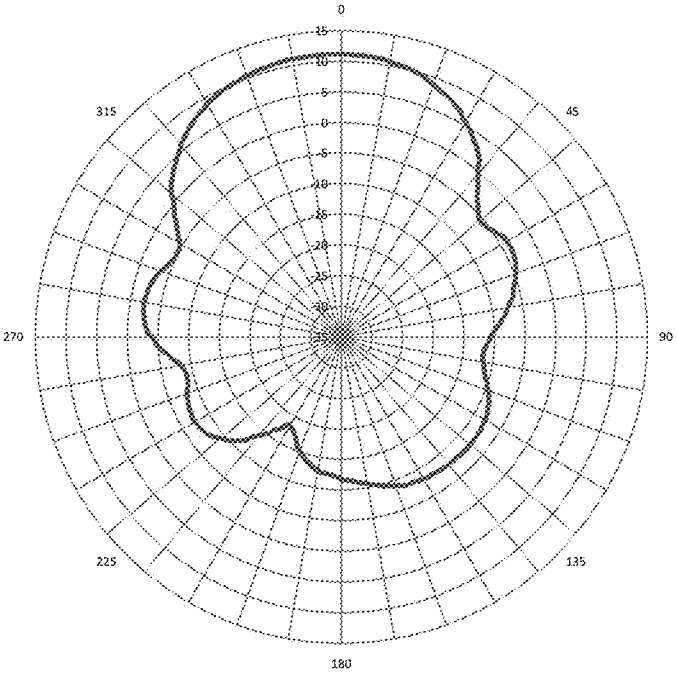
Figure 35:
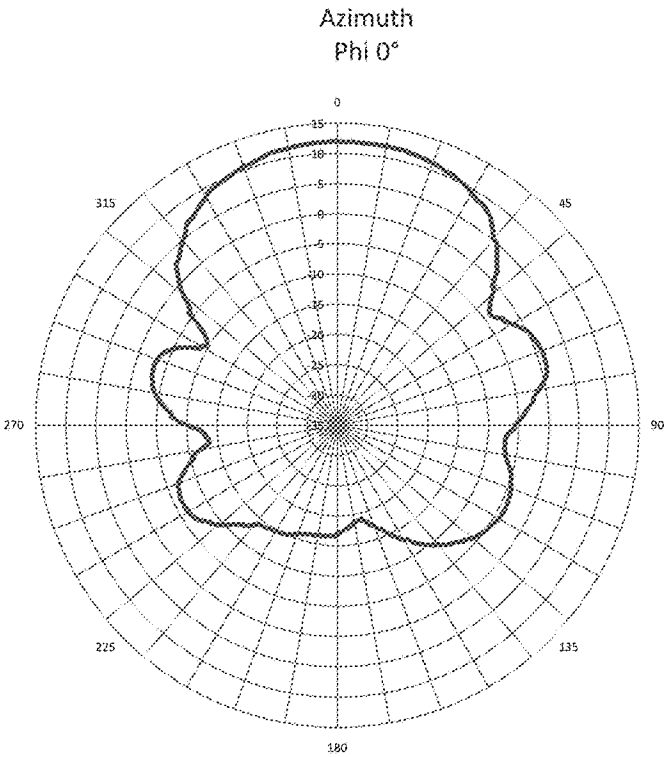
Figure 36:
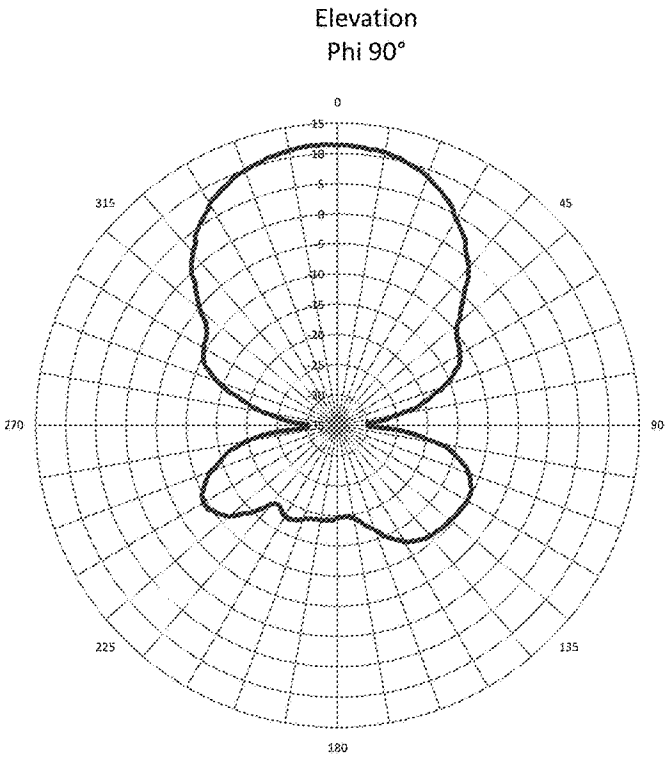
Figure 37:
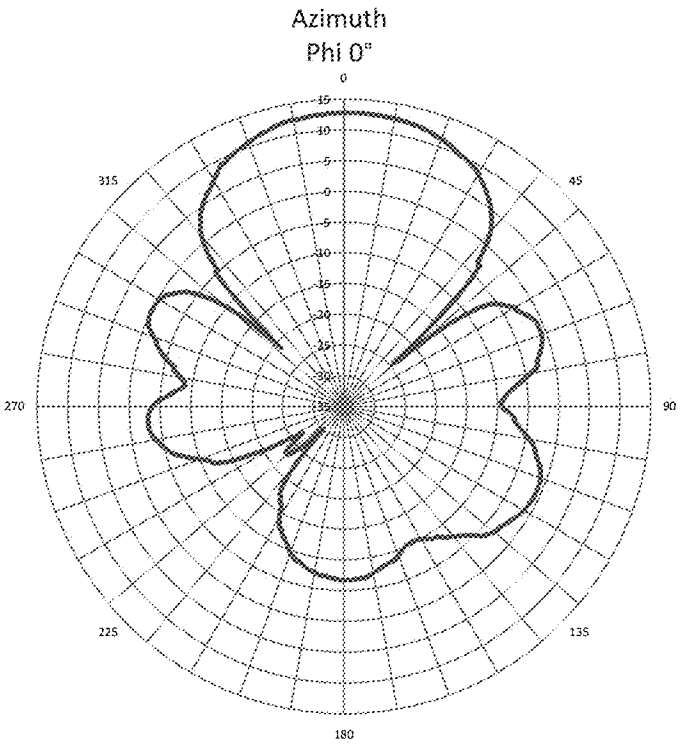
Figure 38:
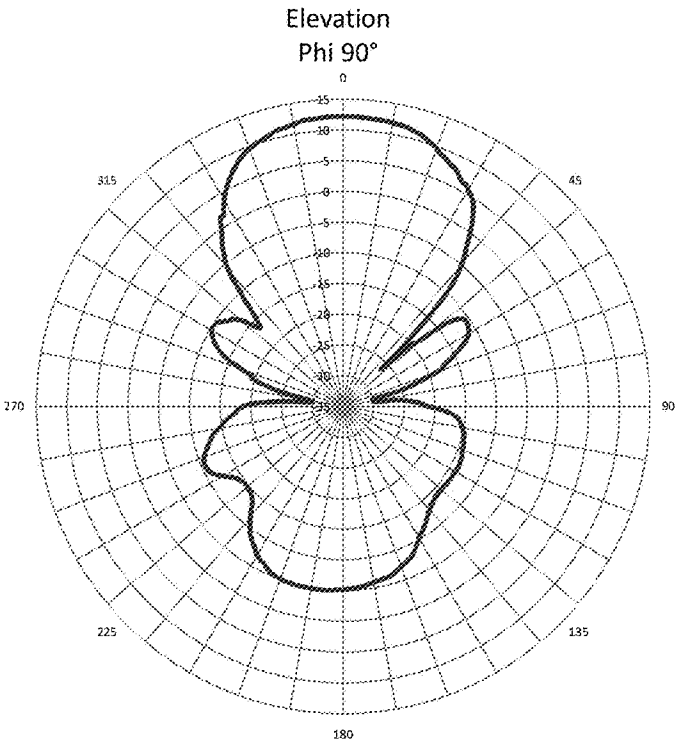

More specifically, FIG. 32 is an exemplary line graph of the voltage standing wave ratio (VSWR) versus frequency in megahertz (MHz) measured for the larger prototype of the antenna assembly 100 shown in FIG. 7. Generally, FIG. 32 shows the S parameters S1 through S10 for the prototype antenna assembly. FIG. 32 also shows that the prototype antenna assembly had good VSWR less than 1.5 for frequencies between about 450 MHz to about 530 MHz.

FIGS. 33 through 38 illustrates radiation patterns respectively for Azimuth Plane Phi=0° and Elevation Plane Phi=90° at a frequencies of 450 MHz, 470 MHz, and 490 MHz measured for the larger prototype of the antenna assembly 100 shown in FIG. 7. Generally, FIGS. 33 through 38 show that the radiation patterns of the antenna assembly are directional.

Figure 39:
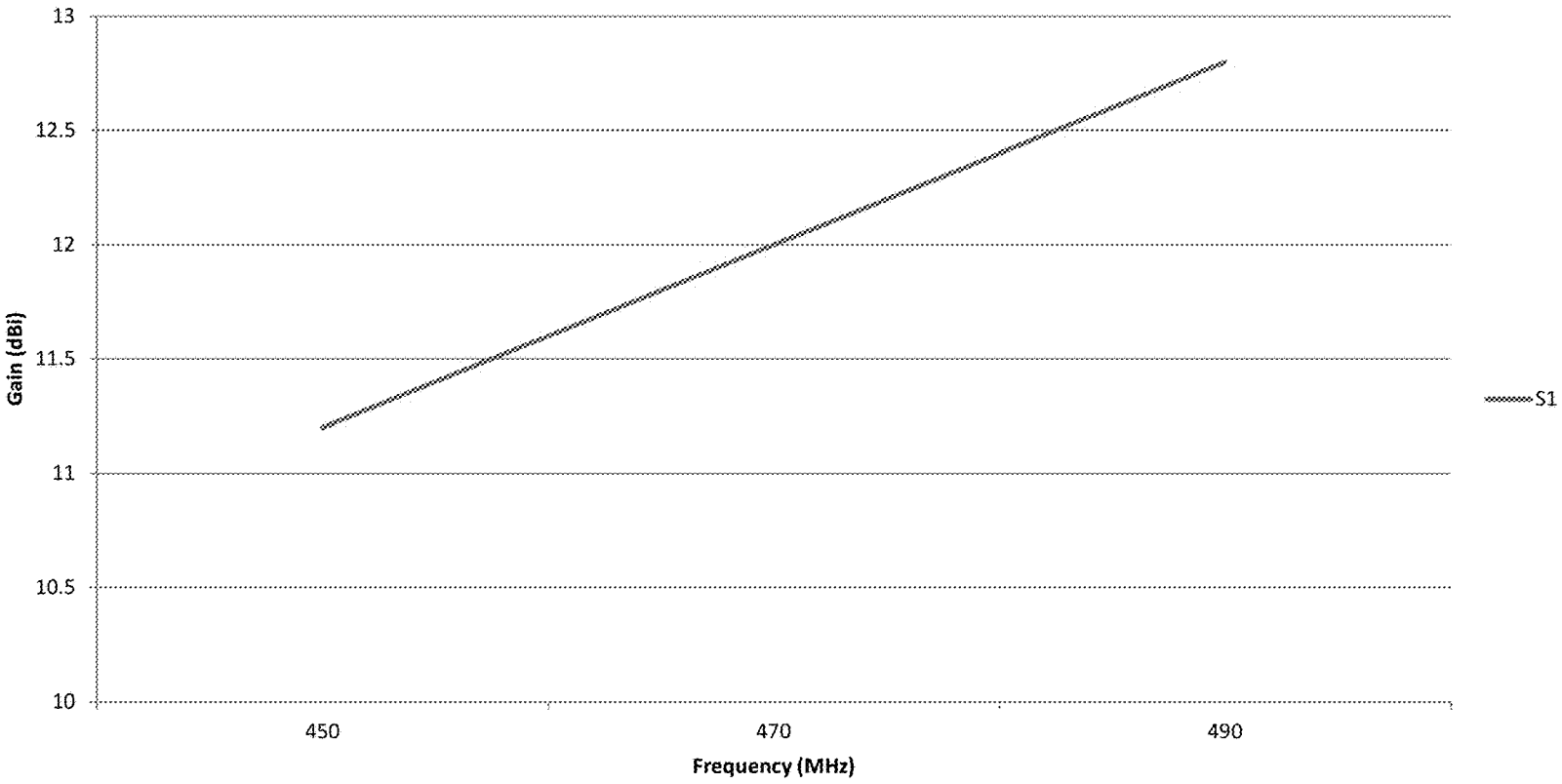
FIG. 39 is an exemplary line graph of gain in decibels relative to isotropic (dBi) versus frequency from 450 MHz to 490 MHz measured for the larger prototype of the antenna assembly according to the exemplary embodiment shown in FIG. 7.

FIG. 39 is an exemplary line graph of gain in decibels relative to isotropic (dBi) versus frequency from 450 MHz to 490 MHz measured for the larger prototype of the antenna assembly 100 shown in FIG. 7. Generally, FIG. 39 shows a peak gain of about 12.8 dBi.

Figure 40:
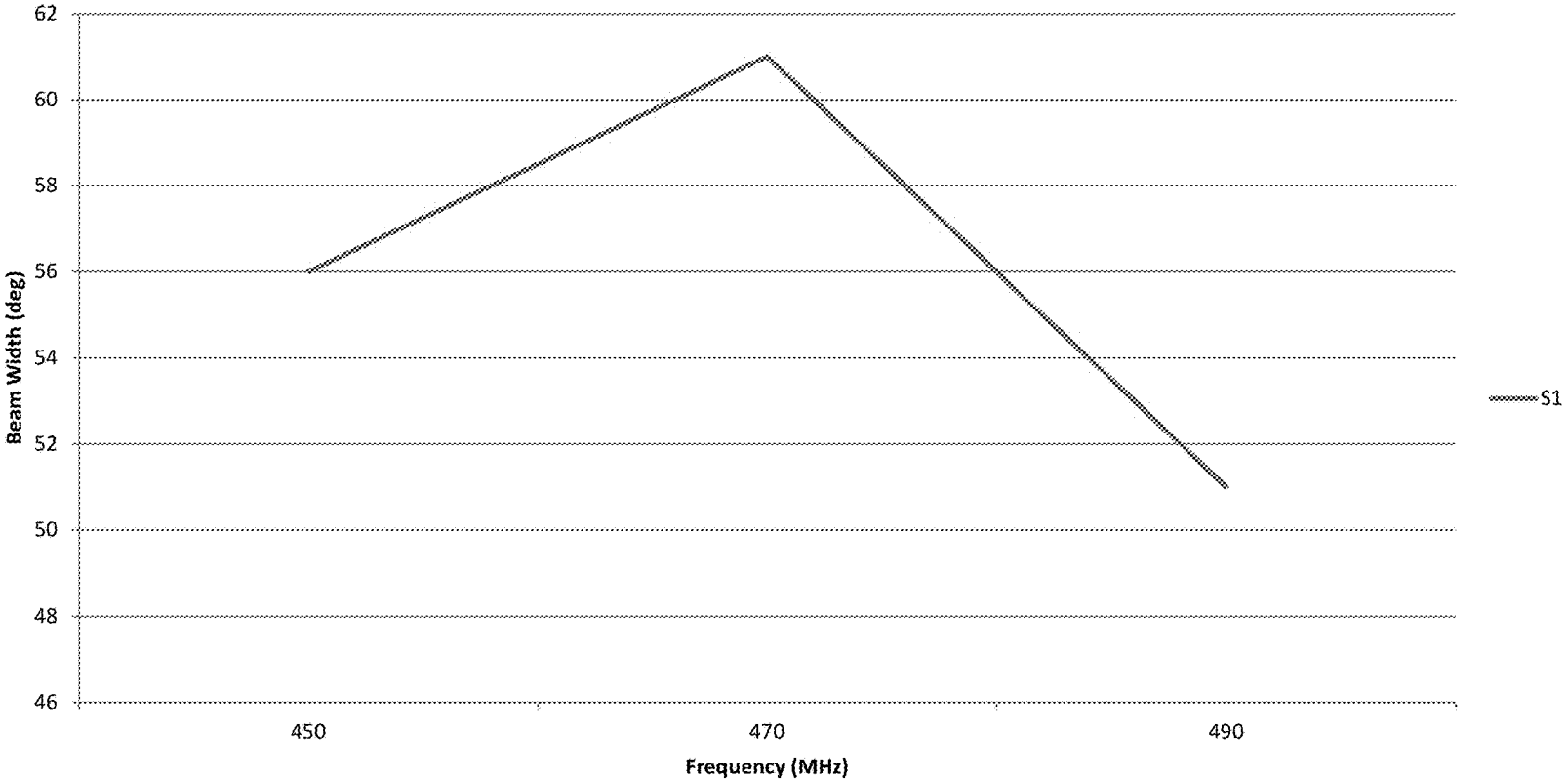
FIG. 40 is an exemplary line graph of Azimuth Plane Beam Width in degrees versus frequency from 450 MHz to 490 MHz measured for the larger prototype of the antenna assembly according to the exemplary embodiment shown in FIG. 7.
Figure 41:
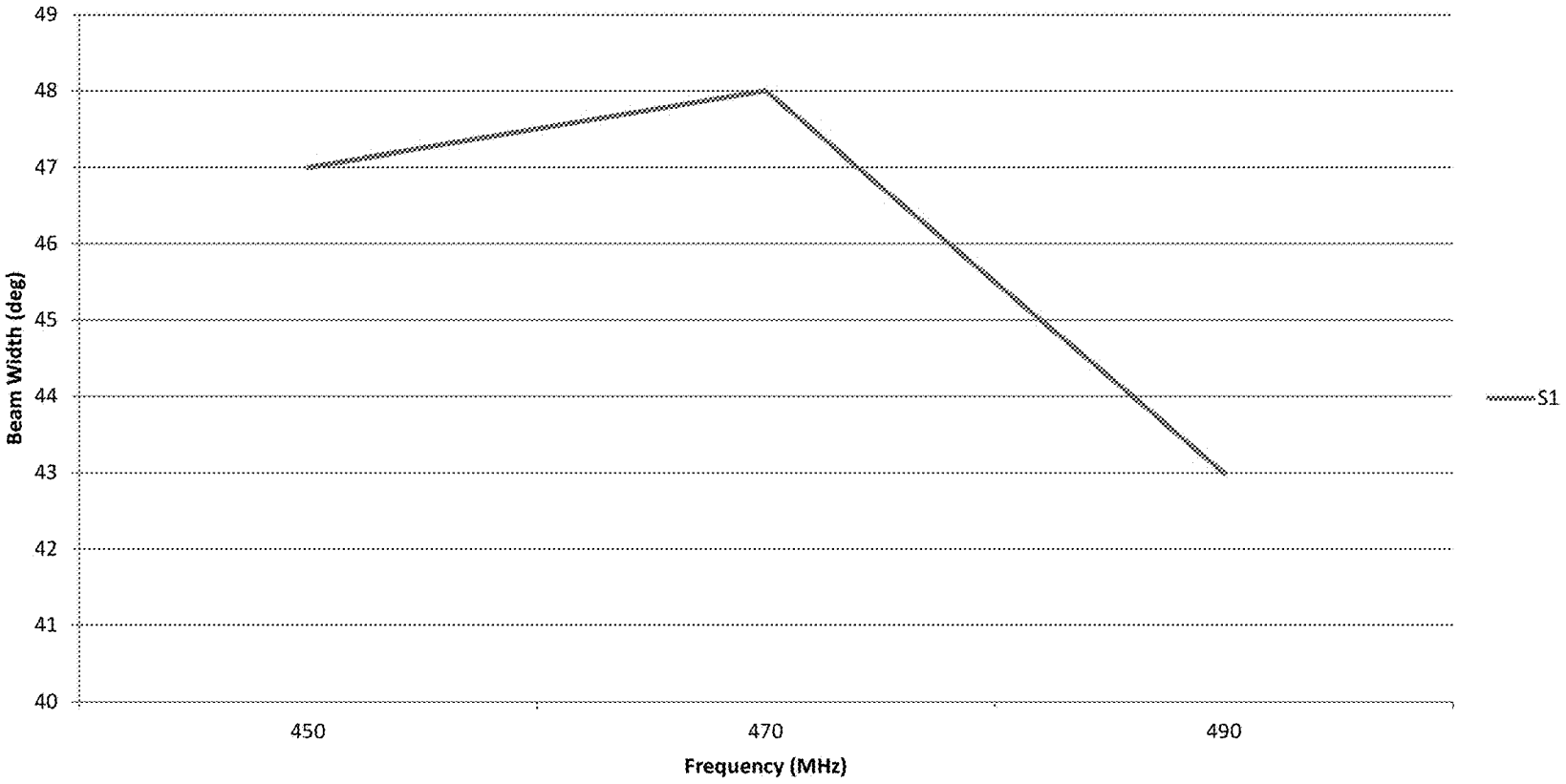
FIG. 41 is an exemplary line graph of Elevation Plane Beam Width in degrees versus frequency from 450 MHz to 490 MHz measured for the larger prototype of the antenna assembly according to the exemplary embodiment shown in FIG. 7.
Figure 42:
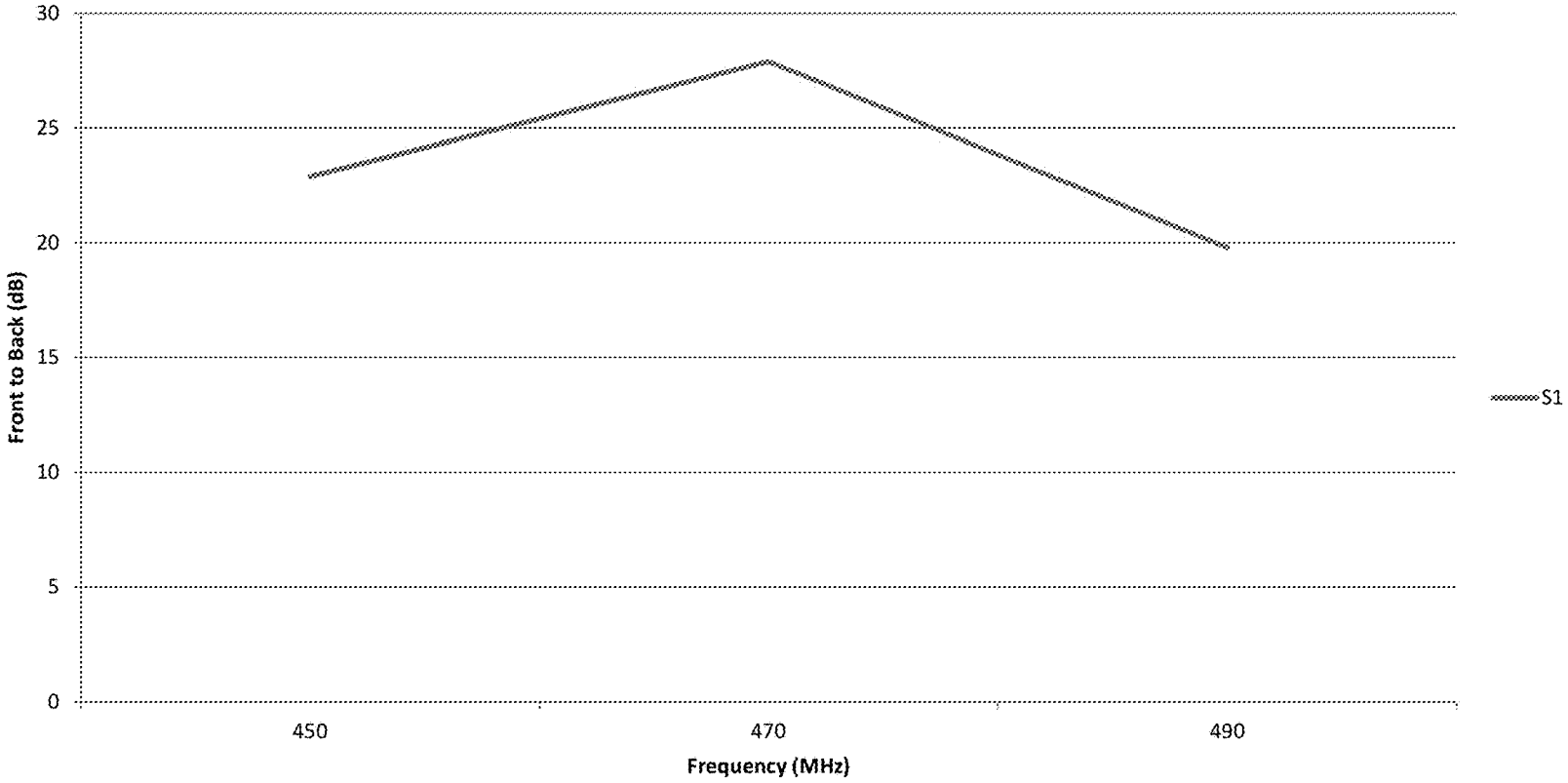
FIG. 42 is an exemplary line graph of front to back ratio in decibels (dB) versus frequency from 450 MHz to 490 MHz measured for the larger prototype of the antenna assembly according to the exemplary embodiment shown in FIG. 7.

FIG. 40 is an exemplary line graph of Azimuth Plane Beam Width in degrees versus frequency from 450 MHz to 490 MHz measured for the larger prototype of the antenna assembly 100 shown in FIG. 7. FIG. 41 is an exemplary line graph of Elevation Plane Beam Width in degrees versus frequency from 450 MHz to 490 MHz measured for the larger prototype of the antenna assembly 100 shown in FIG. 7. FIG. 42 is an exemplary line graph of front to back ratio in decibels (dB) versus frequency from 450 MHz to 490 MHz measured for the larger prototype of the antenna assembly 100 shown in FIG. 7.

Figure 44:
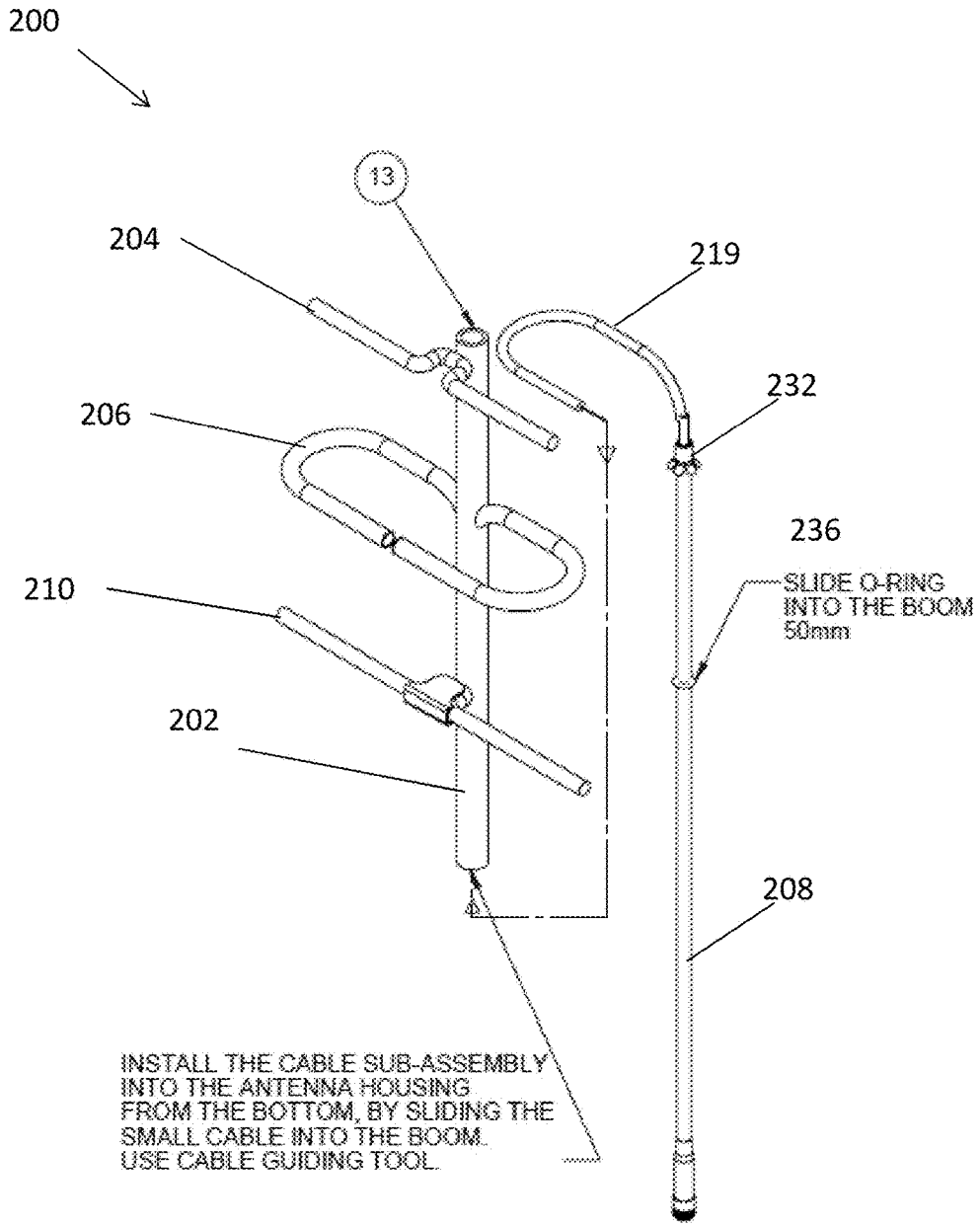
FIG. 44 is a perspective view of the antenna assembly of FIG. 1 showing the first or upper portion (or antenna sub-assembly) that includes dipole elements spaced apart along a boom separate from the second or lower portion (or cable sub-assembly) that includes a first cable (e.g., coaxial feed cable, etc.), grounding elements, and a second cable (e.g., internally fed coaxial jumper, etc.)

FIGS. 43 and 44 illustrates another exemplary embodiment of an antenna assembly 200 embodying one or more aspects of the present disclosure. As disclosed herein, the antenna assembly 200 may also be referred to as a Yagi-Uda antenna or Yagi antenna. The antenna assembly 200 includes a boom 202 (broadly, a support structure) and a plurality of dipole elements spaced apart along a length of the boom 202. The plurality of dipole elements includes a director dipole element 204, a folded dipole element 206, and a reflector dipole element 210. The antenna assembly 200 also includes a first transmission line or cable 208 (e.g., coaxial feed cable, other suitable transmission lines, etc.).

The antenna assembly 200 may be similar or substantially identical to the antenna 100 described above and shown in FIG. 1. For example, the director dipole element 204, a folded dipole element 206, and a reflector dipole element 210 may be similar or substantially identical to the director dipole element 104, a folded dipole element 106, and a reflector dipole element 110 of the antenna assembly 100. Also, the cable 208 (which may be a coaxial cable or the like) may be fed into the hollow body of the boom 202 and inserted into an inner portion of the folded dipole element 206 as described above for cable 108. As shown in FIG. 44, the cable sub-assembly including the first cable 208 (e.g., coaxial feed cable, etc.), second cable 219 (e.g., internally fed coaxial jumper, etc.), leaf spring 232, and O-ring 236 may be installed into the antenna housing or boom 202 from the bottom by sliding the second cable 219 into the boom 202, e.g., using a cable guiding tool, etc.

The antenna assembly 200 has less dipole elements than the antenna assembly 100. Accordingly, the antenna assembly 200 may have a lower peak gain (e.g., 8.6 dBi versus 12 dBi, etc.) than the antenna assembly 100.

FIGS. 45 through 56 provide results measured for a prototype of the antenna assembly 200 shown in FIG. 43 and having the following performance characteristics: operating frequency range from about 890 MHz to about 960 MHz, VSWR max of 1.5:1 or 1.66:1, maximum gain of about 8.4 or 8.5 dBi, typical gain of about 8.1 or 8.3 dBi, Azimuth Co-Polar Beam Width of about 90 degrees, Elevation Co-Polar Beam Width of about 63 degrees, Azimuth Co-Polar First Side lobe of about −68 or −38, Elevation Co-Polar First Side lobe of about −30 or −22, front to back ratio of about 20.7 or 8.5 dB, directional antenna type, female type N connector type, and vertical polarization. These analysis results are provided only for purposes of illustration and not for purposes of limitation as other exemplary embodiments may be configured differently and/or have different performance.

Figure 45:
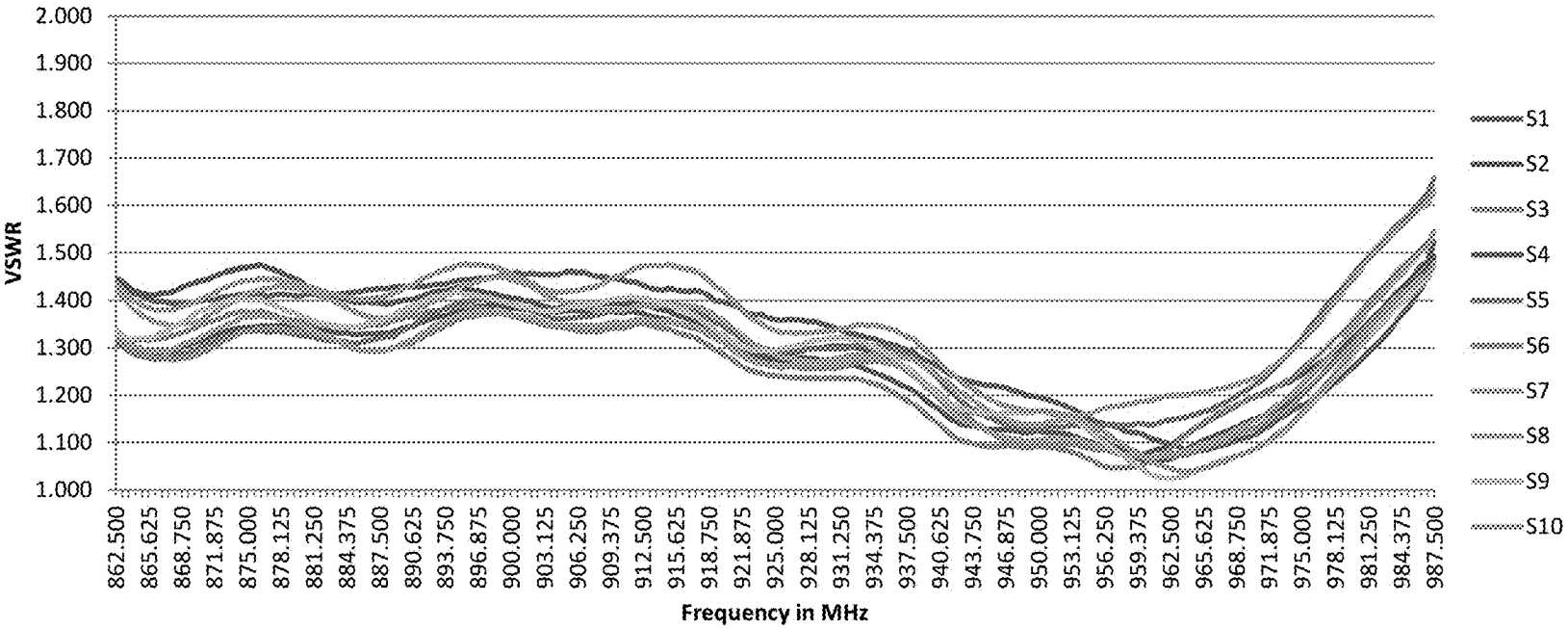
FIG. 45 is an exemplary line graph of voltage standing wave ratio (VSWR) versus frequency in megahertz (MHz) measured for a prototype of the antenna assembly according to the exemplary embodiment shown in FIG. 43.
Figure 46:
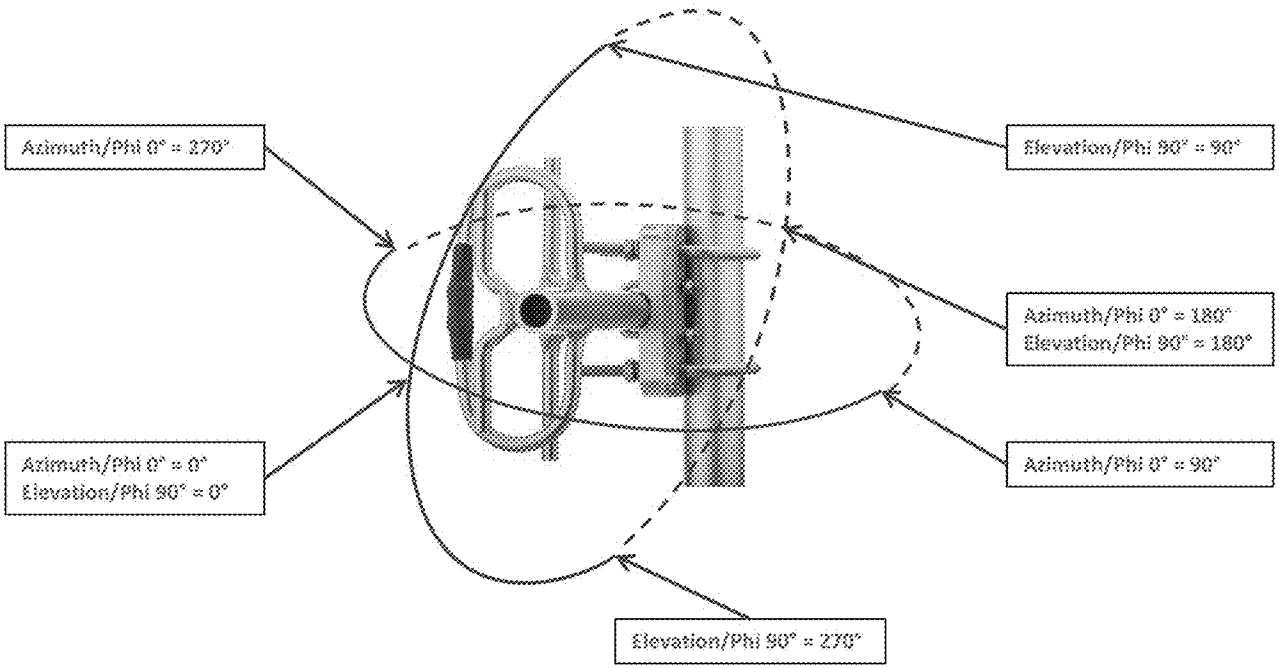
FIG. 46 illustrates the radiation patterns orientation for the antenna assembly according to the exemplary embodiment shown in FIG. 43.
Figure 47:
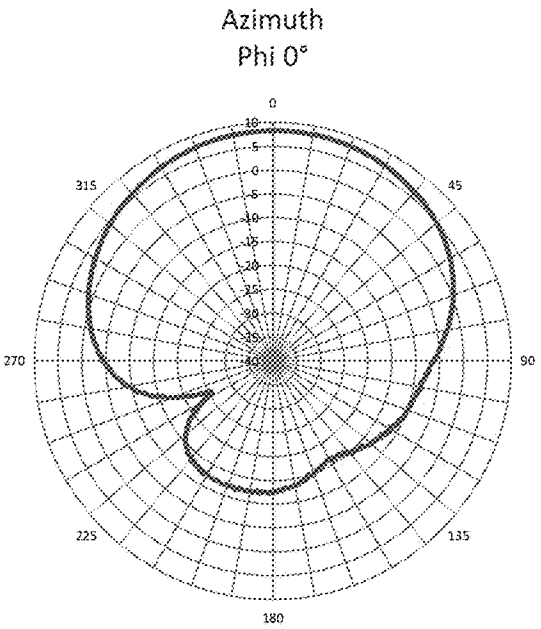
FIGS. 47 through 52 illustrates radiation patterns respectively for Azimuth Plane Phi=0° and Elevation Plane Phi=90° at a frequencies of 890 MHz, 925 MHz, and 960 MHz measured for a prototype of the antenna assembly shown in FIG. 43.
Figure 48:
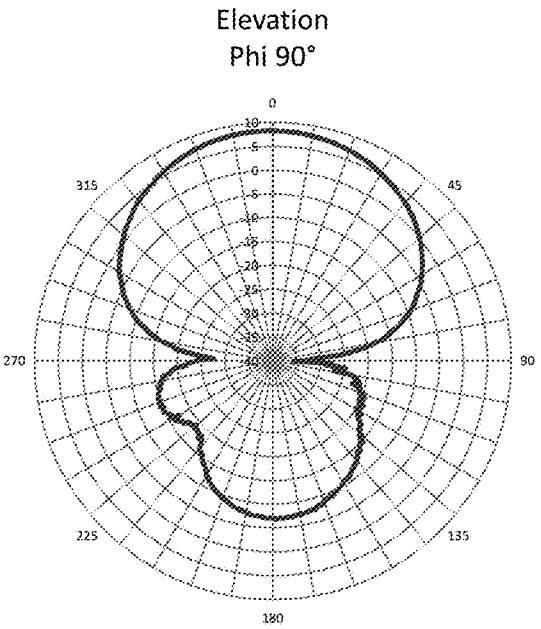
Figure 49:
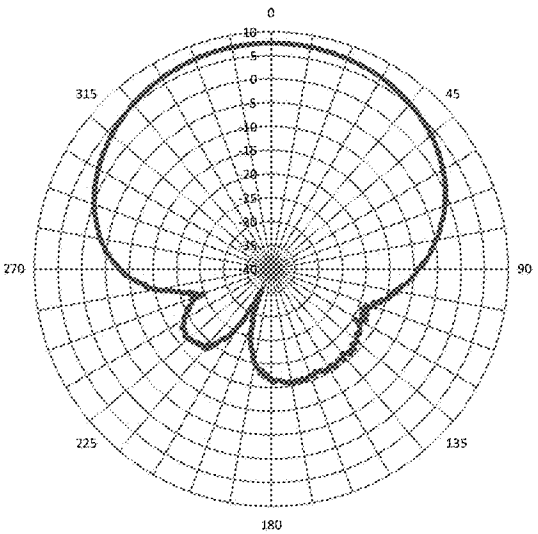
Figure 50:
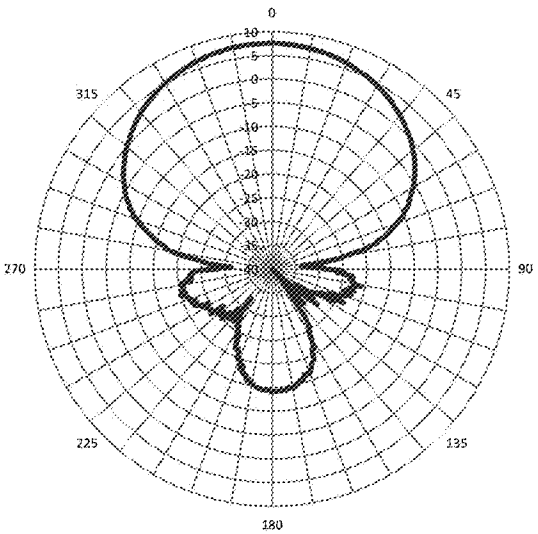
Figure 51:
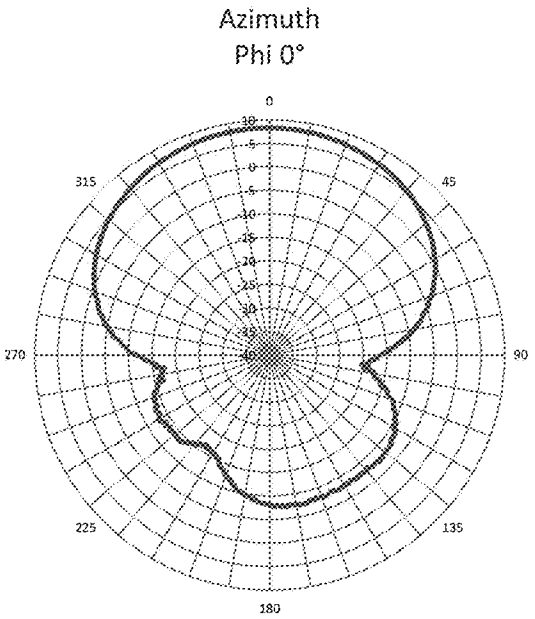
Figure 52:
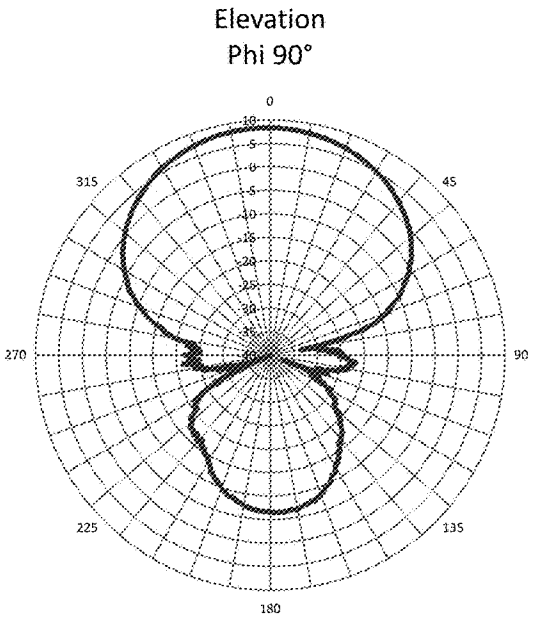

More specifically, FIG. 45 is an exemplary line graph of the voltage standing wave ratio (VSWR) versus frequency in megahertz (MHz) measured for a prototype of the antenna assembly 200 shown in FIG. 43. Generally, FIG. 45 shows the S parameters 51 through S10 for the prototype antenna assembly. FIG. 45 also shows that the prototype antenna assembly had good VSWR less than 1.5 for frequencies between about 862.5 MHz to about 981 MHz.

FIGS. 47 through 52 illustrates radiation patterns respectively for Azimuth Plane Phi=0° and Elevation Plane Phi=90° at a frequencies of 890 MHz, 925 MHz, and 960 MHz measured for a prototype of the antenna assembly 200 shown in FIG. 43. Generally, FIGS. 47 through 52 show that the radiation patterns of the antenna assembly are directional.

Figure 53:
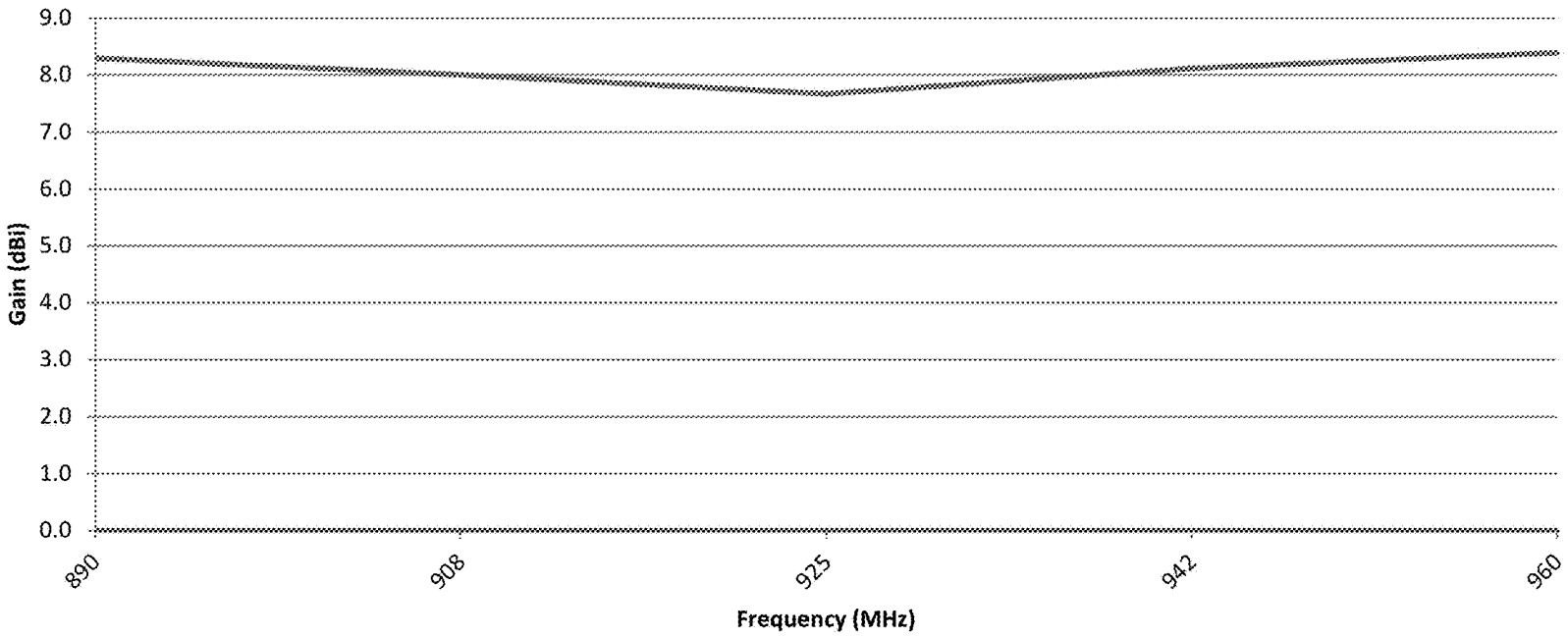
FIG. 53 is an exemplary line graph of gain in decibels relative to isotropic (dBi) versus frequency from 890 MHz to 960 MHz measured for a prototype of the antenna assembly according to the exemplary embodiment shown in FIG. 43.

FIG. 53 is an exemplary line graph of gain in decibels relative to isotropic (dBi) versus frequency from 890 MHz to 960 MHz measured for a prototype of the antenna assembly 200 shown in FIG. 43. Generally, FIG. 28 shows a peak gain of about 8.4 dBi.

Figure 54:
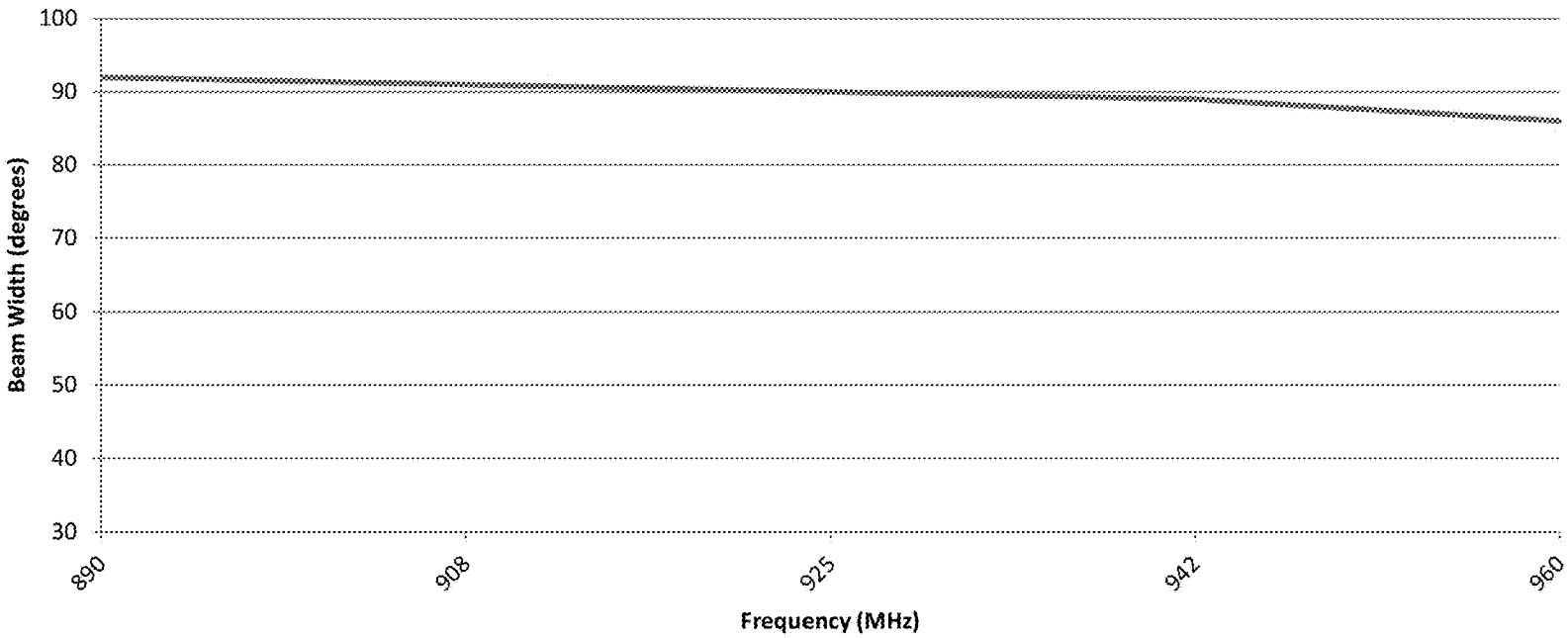
FIG. 54 is an exemplary line graph of Azimuth Plane Beam Width in degrees versus frequency from 890 MHz to 960 MHz measured for a prototype of the antenna assembly according to the exemplary embodiment shown in FIG. 43.
Figure 55:
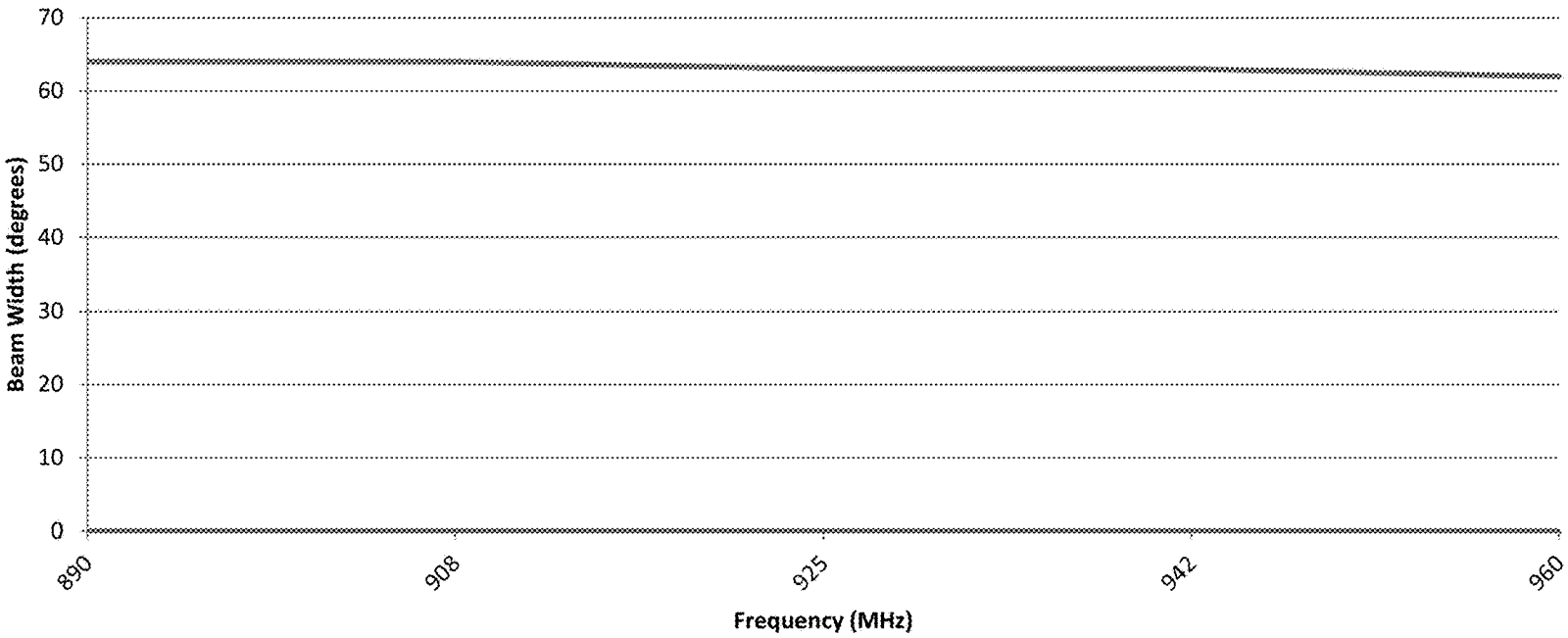
FIG. 55 is an exemplary line graph of Elevation Plane Beam Width in degrees versus frequency from 890 MHz to 960 MHz measured for a prototype of the antenna assembly according to the exemplary embodiment shown in FIG. 43.
Figure 56:
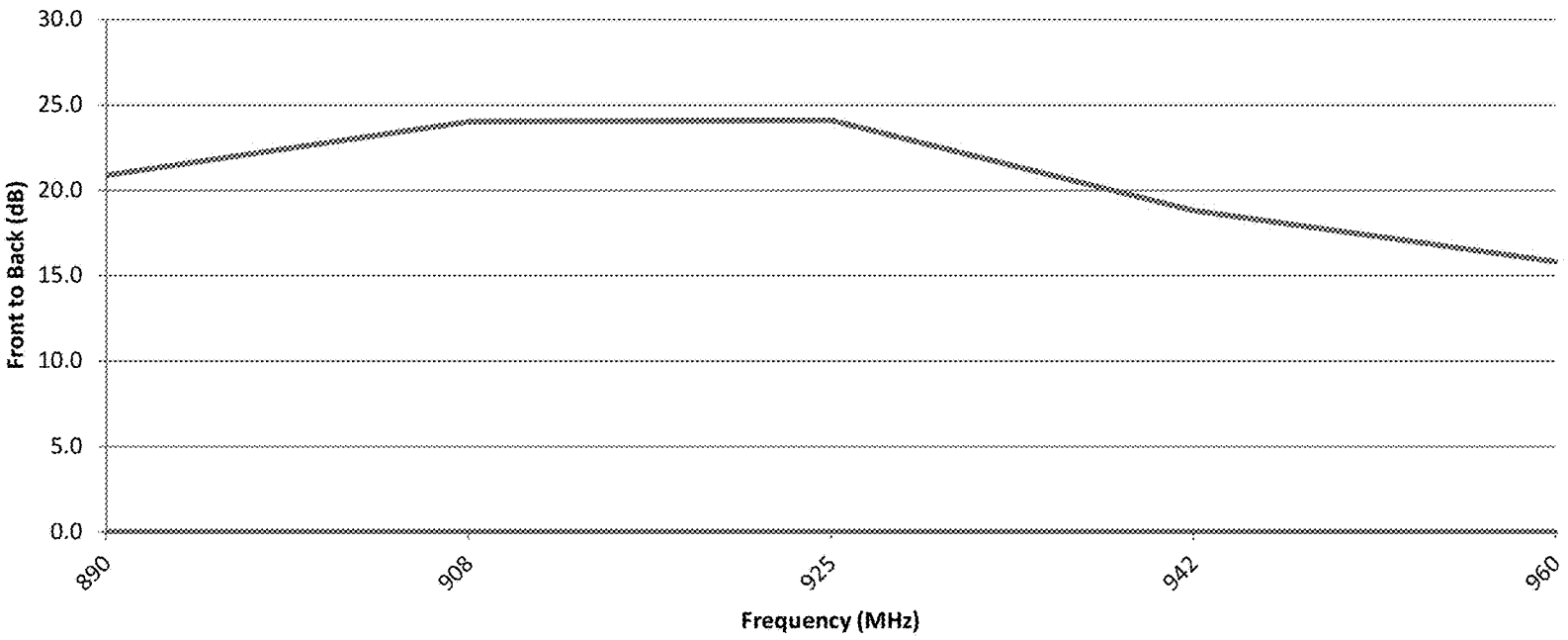
FIG. 56 is an exemplary line graph of front to back ratio in decibels (dB) versus frequency from 890 MHz to 960 MHz measured for a prototype of the antenna assembly according to the exemplary embodiment shown in FIG. 43.

FIG. 54 is an exemplary line graph of Azimuth Plane Beam Width in degrees versus frequency from 890 MHz to 960 MHz measured for a prototype of the antenna assembly 200 shown in FIG. 43. FIG. 55 is an exemplary line graph of Elevation Plane Beam Width in degrees versus frequency from 890 MHz to 960 MHz measured for a prototype of the antenna assembly 200 shown in FIG. 43. FIG. 56 is an exemplary line graph of front to back ratio in decibels (dB)

versus frequency from 890 MHz to 960 MHz measured for a prototype of the antenna assembly 200 shown in FIG. 43.

FIGS. 57 through 67 provide results measured for a larger prototype of the antenna assembly 200 shown in FIG. 43 and having the following performance characteristics: operating frequency range from about 450 MHz to about 490 MHz, VSWR max of 1.5:1, maximum gain of about 9.1 dBi, typical gain of about 8.7 dBi, Azimuth Co-Polar Beam Width of about 92 degrees, Elevation Co-Polar Beam Width of about 70 degrees, front to back ratio of about 17.6 dB, directional antenna type, female type N connector type, and vertical or horizontal polarization. These analysis results are provided only for purposes of illustration and not for purposes of limitation as other exemplary embodiments may be configured differently and/or have different performance.

Figure 57:
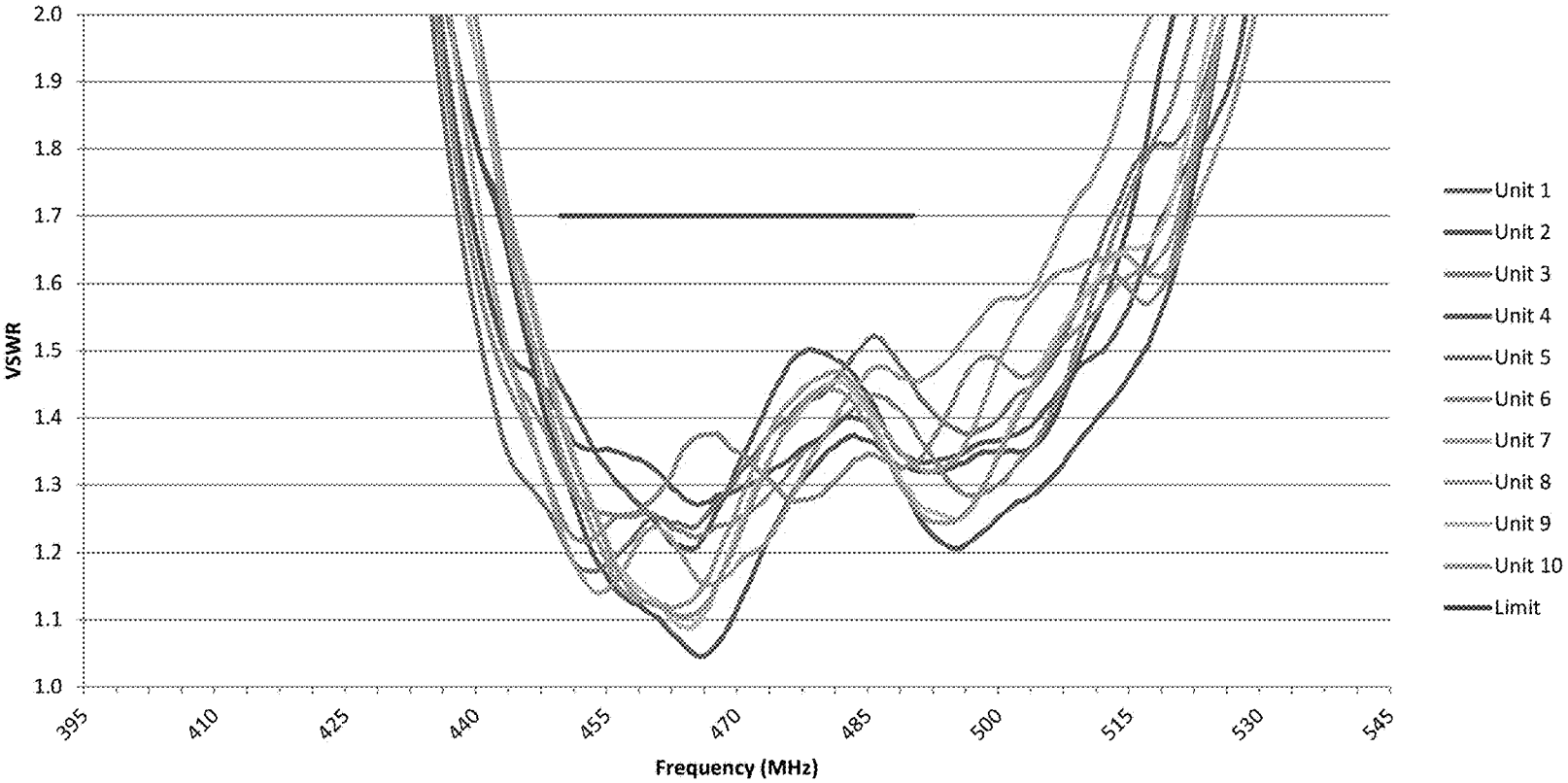
FIG. 57 is an exemplary line graph of voltage standing wave ratio (VSWR) versus frequency in megahertz (MHz) measured for a larger prototype of the antenna assembly according to the exemplary embodiment shown in FIG. 43.
Figure 58:
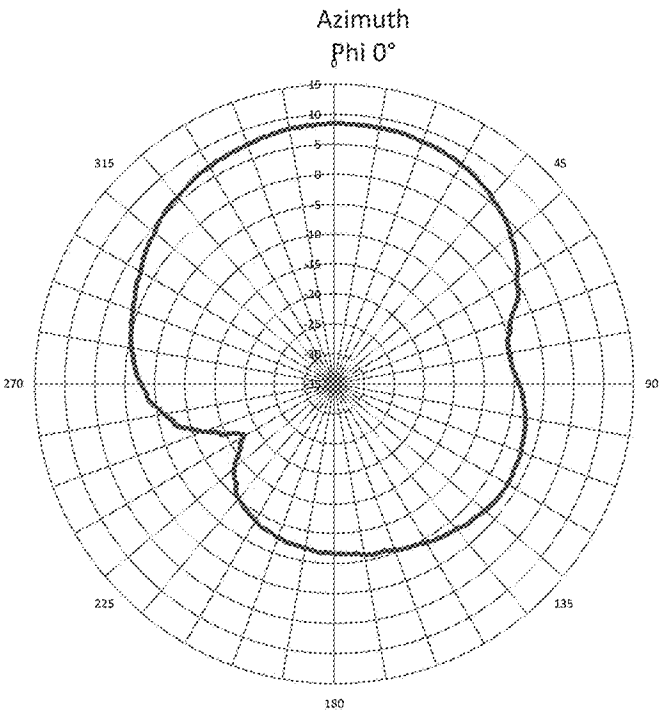
FIGS. 58 through 63 illustrates radiation patterns respectively for Azimuth Plane Phi=0° and Elevation Plane Phi=90° at a frequencies of 450 MHz, 70 MHz, and 490 MHz measured for the larger prototype of the antenna assembly shown in FIG. 43.
Figure 59:
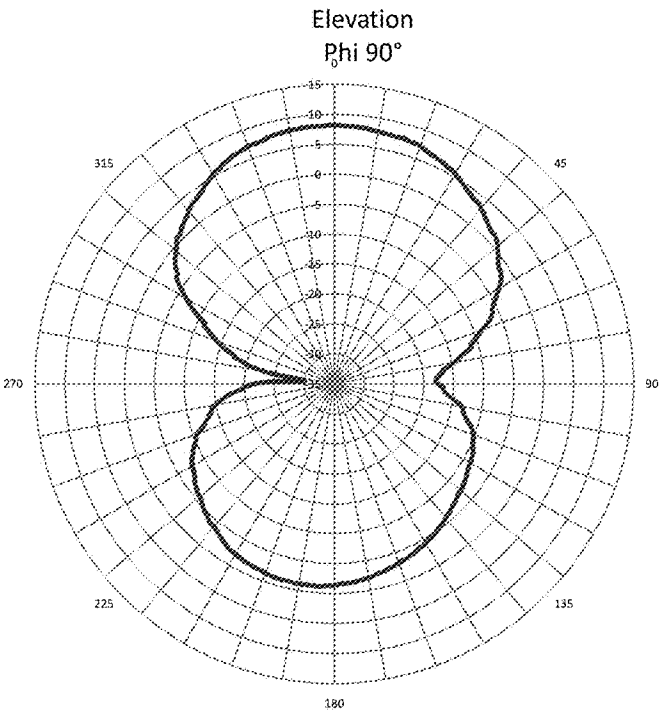
Figure 61:
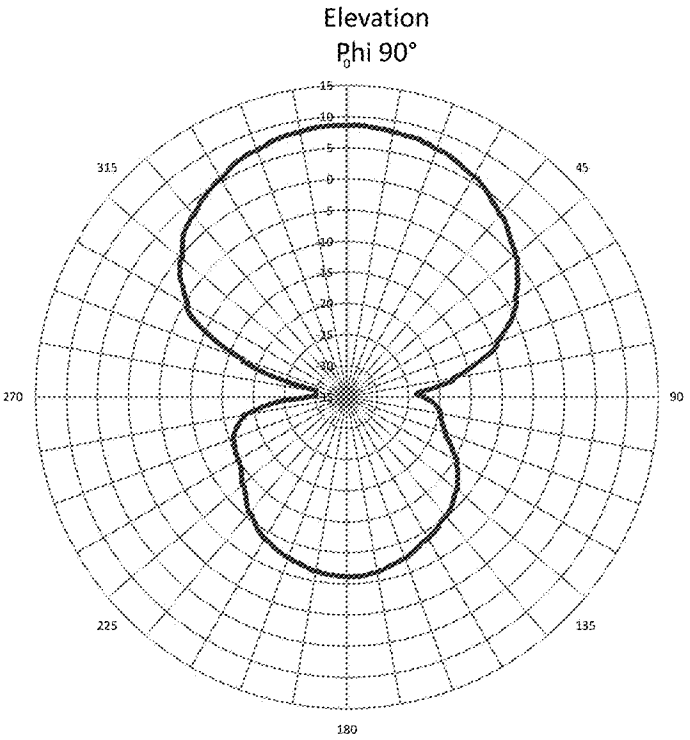
Figure 60:
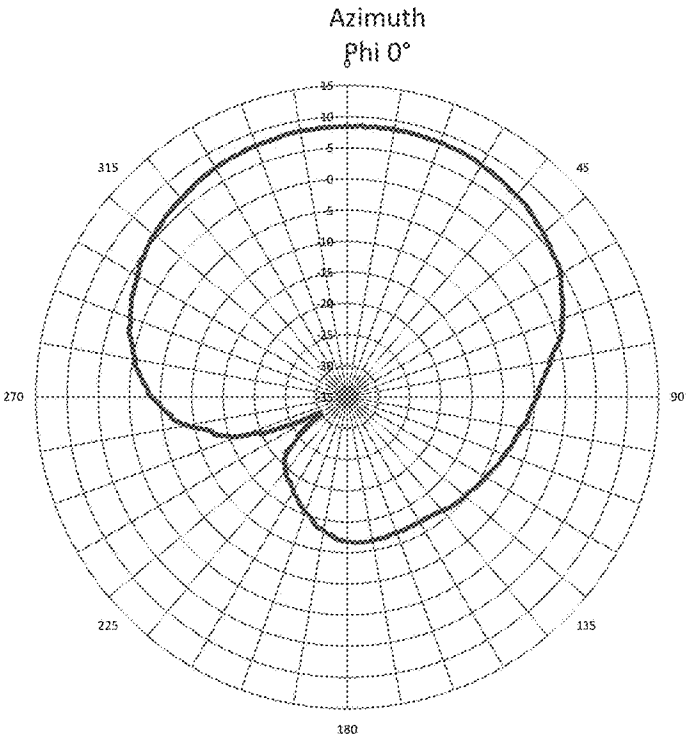
Figure 62:
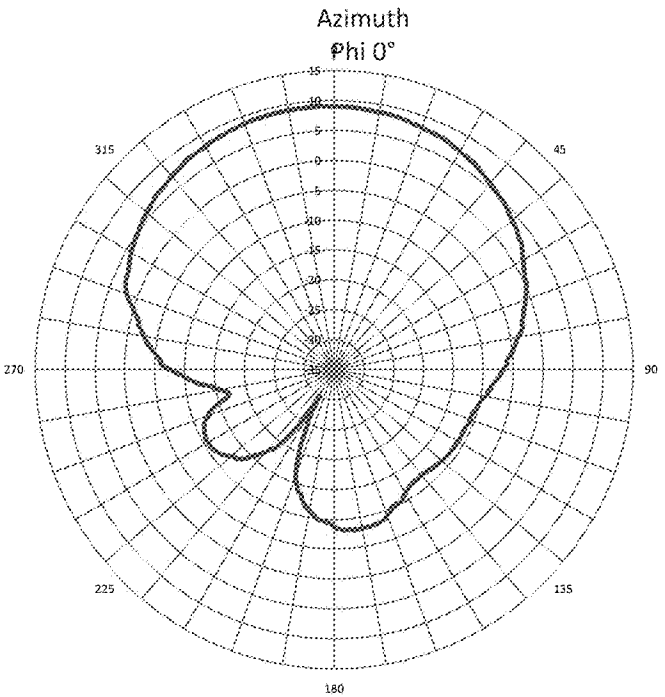
Figure 63:
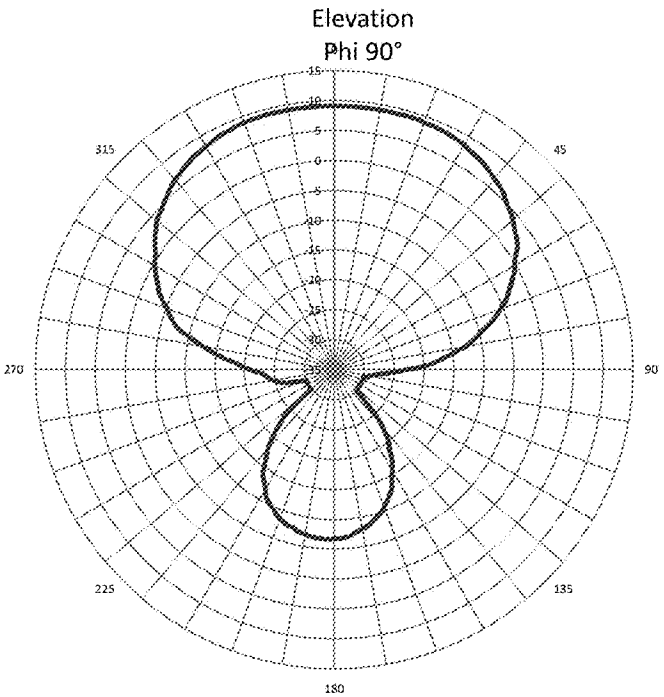

More specifically, FIG. 57 is an exemplary line graph of the voltage standing wave ratio (VSWR) versus frequency in megahertz (MHz) measured for the larger prototype of the antenna assembly 200 shown in FIG. 43. Generally, FIG. 57 shows the S parameters 51 through S10 for the prototype antenna assembly. FIG. 57 also shows that the prototype antenna assembly had good VSWR less than 1.7 for frequencies between about 450 MHz to about 500 MHz.

FIGS. 58 through 63 illustrates radiation patterns respectively for Azimuth Plane Phi=0° and Elevation Plane Phi=90° at a frequencies of 450 MHz, 470 MHz, and 490 MHz measured for the larger prototype of the antenna assembly 200 shown in FIG. 43. Generally, FIGS. 58 through 63 show that the radiation patterns of the antenna assembly are directional.

Figure 64:
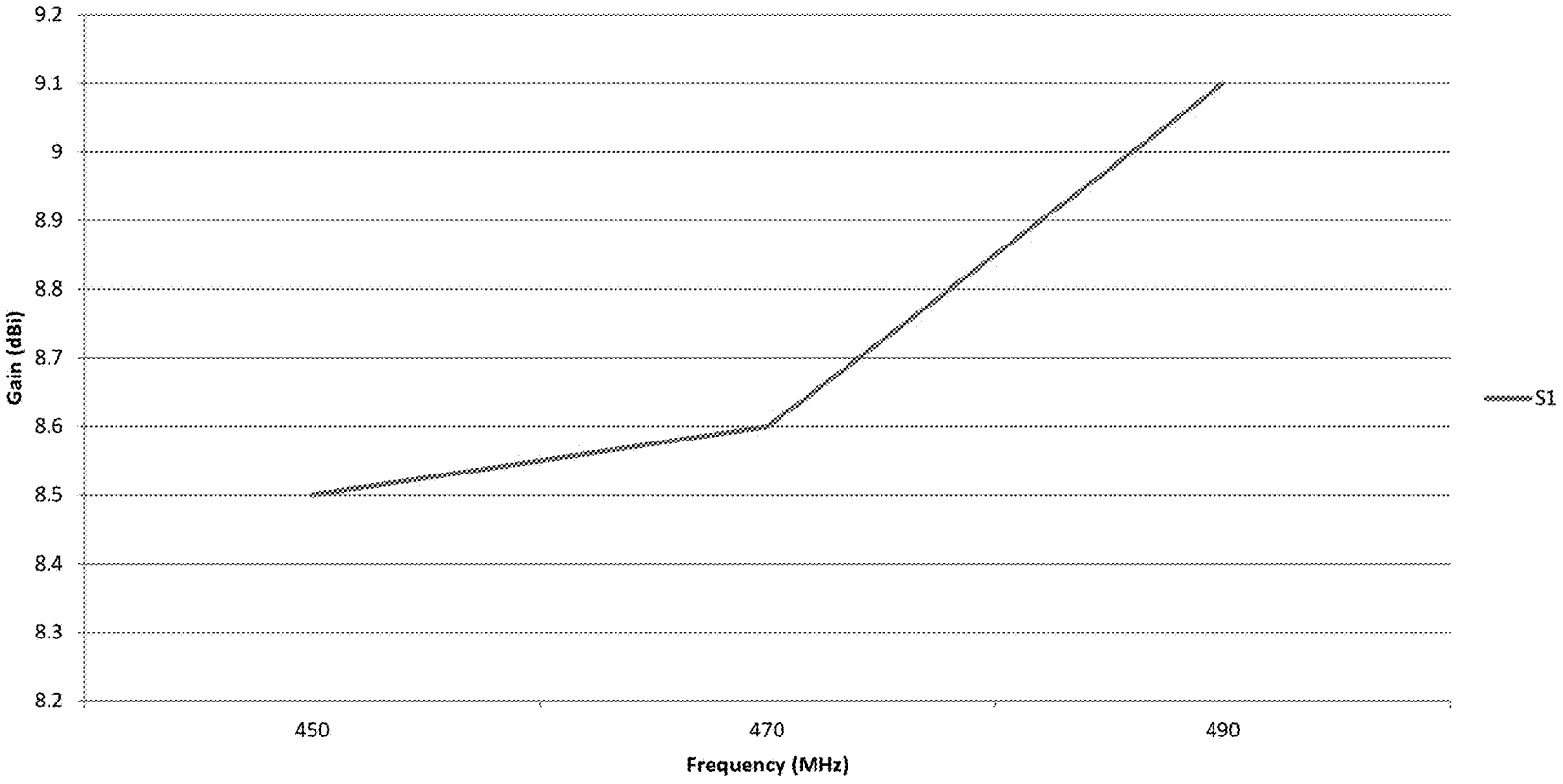
FIG. 64 is an exemplary line graph of gain in decibels relative to isotropic (dBi) versus frequency from 450 MHz to 490 MHz measured for the larger prototype of the antenna assembly according to the exemplary embodiment shown in FIG. 43.

FIG. 64 is an exemplary line graph of gain in decibels relative to isotropic (dBi) versus frequency from 450 MHz to 490 MHz measured for the larger prototype of the antenna assembly 200 shown in FIG. 43. Generally, FIG. 64 shows a peak gain of about 9.1 dBi.

Figure 65:
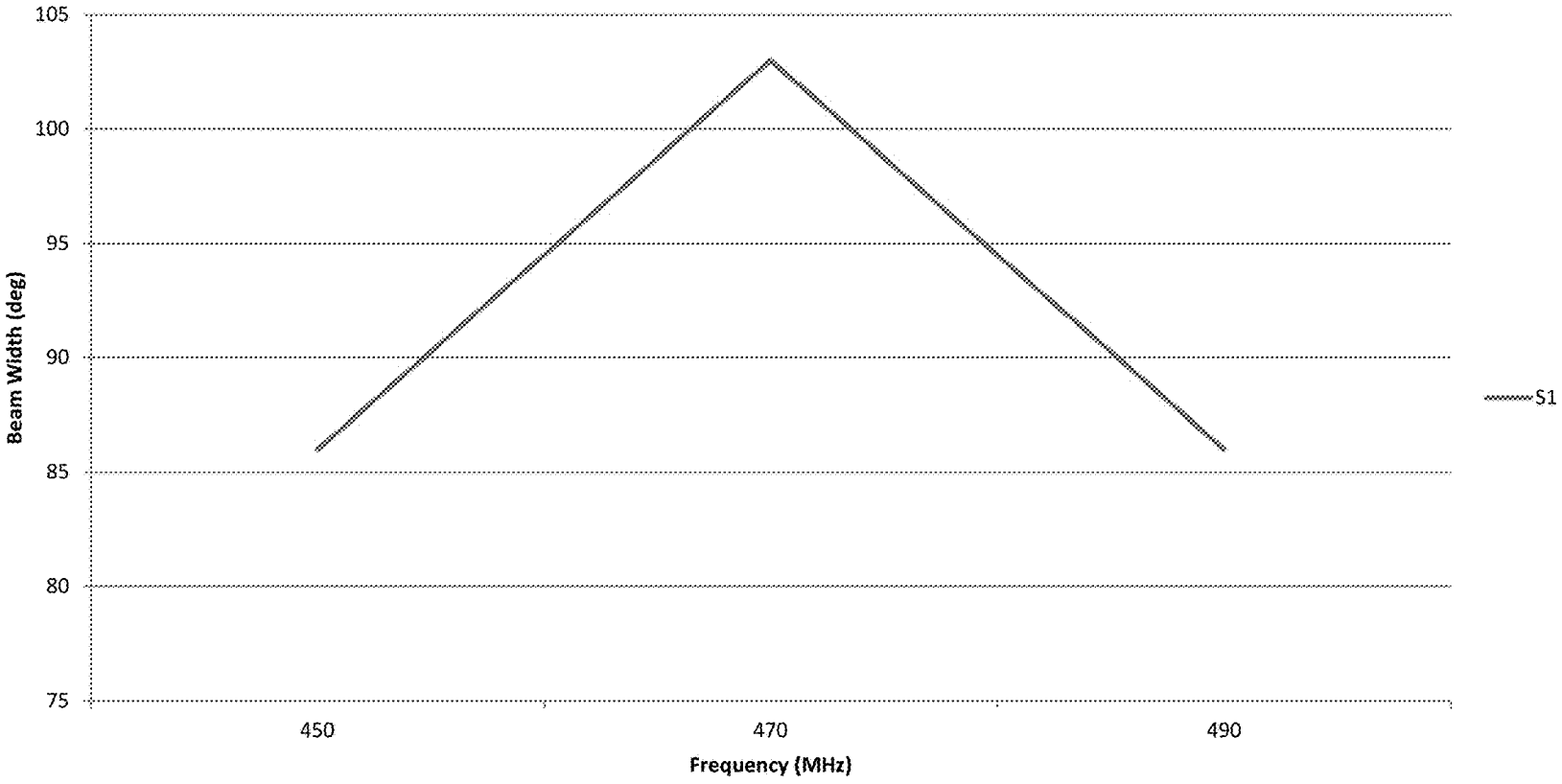
FIG. 65 is an exemplary line graph of Azimuth Plane Beam Width in degrees versus frequency from 450 MHz to 490 MHz measured for the larger prototype of the antenna assembly according to the exemplary embodiment shown in FIG. 43.

FIG. 65 is an exemplary line graph of Azimuth Plane Beam Width in degrees versus frequency from 450 MHz to 490 MHz measured for the larger prototype of the antenna assembly 200 shown in FIG. 43. FIG. 66 is an exemplary line graph of Elevation Plane Beam Width in degrees versus frequency from 450 MHz to 490 MHz measured for the larger prototype of the antenna assembly 200 shown in FIG. 43. FIG. 67 is an exemplary line graph of front to back ratio in decibels (dB) versus frequency from 450 MHz to 490 MHz measured for the larger prototype of the antenna assembly 200 shown in FIG. 43.

In exemplary embodiments, the antenna assembly (e.g., antenna assembly 100, 200, etc.) may be configured or attuned to frequencies within a first frequency range (e.g., from about 450 MHz to about 490 MHz, etc.) or a second frequency range (e.g., from about 890 MHz to about 960 MHz, etc.). For example, the antenna assembly 100 (FIG. 1) may be configured to have a peak gain of about 12 dBi and good VSWR less than 1.5 for a first frequency range from about 450 MHz to about 490 MHz. Alternatively, the antenna assembly 100 may be sized dimensionally smaller so that the antenna assembly 100 is configured to have a peak gain of about 12 dBi and good VSWR less than 1.5 for a second frequency range from about 890 MHz to about 960 MHz. In these examples, the antenna assembly 100 has a total of seven dipole elements 104, 106, 110 spaced apart along the boom 102. In alternative embodiments, the antenna assembly 100 may have more or less than seven dipole elements in order to respectively increase or decrease the antenna gain. For example, the antenna assembly 200 (FIG. 43) includes three dipole elements 204, 206, 210 spaced apart along the boom 202. The antenna assembly 200 may be configured to have a peak gain of about 8.6 dBi and good VSWR less than 1.5 for a first frequency range from about 450 MHz to about 490 MHz. Alternatively, the antenna assembly 200 may be sized dimensionally smaller so that the antenna assembly 200 is configured to have a peak gain of about 8.6 dBi and good VSWR less than 1.5 for a second frequency range from about 890 MHz to about 960 MHz. In yet other exemplary embodiments, an antenna assembly may include a different number of dipole elements than 3 or 7, such as more than 7 dipole elements, less than 3 dipole elements, 4 dipole elements, 5 dipole elements, or 6 dipole elements.

Exemplary embodiments disclosed herein of directional antenna assemblies including internally fed transmission cables. The antenna assembly may include a boom, a plurality of dipole elements extending from the boom, a folded dipole element extending from the boom, and a cable aligned through the center of the boom and fed into the folded dipole element.

The plurality of dipole elements extending from the boom of the antenna assembly may be formed such that the ends of the plurality of dipole elements align with a plane between the boom and the ends of the folded dipole element.

The folded dipole element of the antenna assembly may be aligned through the center of the boom.

The boom of the antenna assembly may be sealed such that it is rated for the IP67 standard. The boom of the antenna assembly may be sealed by a potting material on the end through which the cable enters and by a rubber plug on the opposite end.

The folded dipole element of the antenna assembly may include a first dipole part and a second dipole part, wherein the cable is fed into the first dipole part and conductively connected to the second dipole part. The first dipole part and second dipole part may be connected by a bushing.

The plurality of dipole elements and the folded dipole element may be spaced along the boom at intervals and may be substantially perpendicular to the boom.

The cable of the antenna assembly may be a coaxial cable including a central conductor, a dielectric material layer surrounding the central conductor, and a cable braid layer around the dielectric material layer. Additionally, the cable may include a spring leaf contact element. The spring leaf contact element may ground the cable to at least one of the boom and the folded dipole element.

Exemplary embodiments are disclosed of methods of manufacturing an antenna assembly. In an exemplary embodiment, a method generally includes attaching a plurality of dipole elements to a boom, attaching a folded dipole element to the boom, and feeding a cable through a first end of the boom and into the folded dipole element.

The method may further include sealing a first end of the boom with potting material after the cable is fed through and sealing a second end of the boom with a rubber plug. The method may include sealing the antenna assembly to satisfy the IP67 standard.

The plurality of dipole elements may be shaped or formed such that the ends of the plurality of dipole elements align with a plane between the boom and the ends of the folded dipole element. The folded dipole element may be attached to the boom such that the folded dipole element is aligned substantially through the center of the boom.

The method may include feeding the cable into a first part of the folded dipole element and connecting a conductor end of the cable to a second part of the folded dipole element. The method may further include covering the connection between the conductor end of the cable and the second part of the folded dipole element with at least one of a rubber layer and a heat shrink layer.

The method may further include attaching a spring leaf contact element to the cable and grounding the cable to one of the boom and the folded dipole element using the spring leaf contact element of the cable.

The method may include attaching the plurality of dipole elements and the folded dipole element to the boom at spaced-apart locations or intervals along the boom and substantially perpendicular to the boom.

Exemplary embodiments of antenna assemblies disclosed herein may have or provide one or more (but not necessarily any or all) of the following features or advantages. For example, an antenna assembly disclosed herein may have a cable assembly that is fed internally inside the hollow interior or structure of the boom and the folded dipole element such that the internally fed cable assembly is protected from and not exposed to the environment (e.g., dirt, dust, water, etc.). For example, the antenna assembly may satisfy the IP67 ingress protection standard where 6 indicates total protection against solid objects/dust and 7 indicates protection against liquids up to and including the effects of immersion in 15 centimeters to 1 meter of liquid. The antenna assembly may be broadband and/or have comparable or better performance than a conventional externally fed folded Yagi antenna. The director dipole elements may have a unique shape that allows the antenna patterns to behave symmetrical and/or may be formed without any added components to weld to the boom. The antenna assembly may have a relatively simple construction (e.g., stamping tools are straight forward, etc.) and/or be cost effective.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific numerical dimensions and values, specific materials, and/or specific shapes disclosed herein are exemplary in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "includes," "including," "has," "have," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly comprising:

a boom;

a plurality of dipole elements spaced apart along the boom, the plurality of dipole elements including a folded dipole element; and a feed cable assembly internally fed inside the boom and a first section of the folded dipole element;

wherein the feed cable assembly comprises:

a first cable extending through an end of the boom and into a hollow interior of the boom, the first cable electrically grounded to an inside wall of the boom; and a second cable electrically connected with the first cable, the second cable extending from the hollow interior of the boom through a hollow interior of the first section of the folded dipole element.

2. The antenna assembly of claim 1, further comprising an O-ring disposed around the first cable, the O-ring configured to form a seal between an outer surface of the first cable and an inner surface of the boom.

3. The antenna assembly of claim 2, wherein:

the folded dipole element includes the first section and a second section spaced apart from the first section such that a gap is between end portions of the first and second sections;

the second cable includes a center conductor that extends across the gap and is electrically connected with the end portion of the second section of the folded dipole element.

4. The antenna assembly of claim 3, wherein:

the first cable includes a center conductor having a first end portion electrically connected with a first end portion of the center conductor of the second cable; and a second end portion of the center conductor of the second cable extends across the gap to a bushing within the end portion of the second section to thereby electrically connect the center conductor of the second cable to the second section of the folded dipole element.

5. The antenna assembly of claim 4, wherein:

the first cable comprises a coaxial feed cable; and the second cable comprises a coaxial jumper.

6. The antenna assembly of claim 2, further comprising a spring leaf contact coupled to the first cable of the feed cable assembly and in contact with the inside wall of the boom to thereby electrically ground the first cable of the feed cable assembly to the inside wall of the boom; and wherein:

the plurality of dipole elements further comprise a reflector dipole element and multiple director dipole elements spaced apart along the boom;

each of the multiple director dipole elements include a middle section attached to the boom, two generally straight parallel end portions, and two connecting portions between the middle section and a corresponding one of the end portions, each of the two connecting portions being curved, angled, or slanted relative to the middle section such that each of the two connecting portions are non-parallel with the middle section and end portions and such that end portions extend above and away from the boom; and the reflector dipole element and the director dipole elements are aligned such that a plane defined by end portions of the reflector dipole element and the director dipole elements is spaced apart from the boom and passes between the boom and end portions of the folded dipole element.

7. The antenna assembly of claim 1, wherein:

the folded dipole element includes the first section and a second section spaced apart from the first section such that a gap is between end portions of the first and second sections; and the gap is aligned with a center of the boom.

8. The antenna assembly of claim 1, wherein:

the folded dipole element includes the first section and a second section;

the first and second sections of the folded dipole element are attached to the boom along opposite sides of the boom; and a joint between the first section of the folded dipole element and the boom is tapered to thereby allow the feed cable assembly to pass from inside the boom into the first section of the folded dipole element.

9. The antenna assembly of claim 1, wherein the plurality of dipole elements further comprise a reflector dipole element and multiple director dipole elements spaced apart along the boom.

10. The antenna assembly of claim 9, wherein:

each of the multiple director dipole elements include a middle section attached to the boom, two generally straight parallel end portions, and two connecting portions between the middle section and a corresponding one of the end portions, each of the two connecting portions being curved, angled, or slanted relative to the middle section such that each of the two connecting portions are non-parallel with the middle section and end portions and such that end portions extend above and away from the boom.

11. The antenna assembly of claim 9, wherein the reflector dipole element and the director dipole elements are aligned such that a plane defined by end portions of the reflector dipole element and the director dipole elements is spaced apart from the boom and passes between the boom and end portions of the folded dipole element.

12. The antenna assembly of claim 1, further comprising:

a potting material within an open end of the boom through which the feed cable assembly is fed into the boom; and a sealing member disposed within an opposite open end of the boom;

whereby the potting material and the sealing member are operable for respectively sealing both the open end and the opposite open end of the boom and inhibiting foreign objects and liquid from entering the hollow interior of the boom.

13. A Yagi antenna assembly comprising:

a boom;

a folded dipole element coupled to and/or supported by the boom;

a first cable extending through an end of the boom and into a hollow interior of the boom;

a second cable electrically connected with the first cable, the second cable extending through a hollow interior of a first section of the folded dipole element;

a reflector dipole element; and multiple director dipole elements spaced apart along the boom;

wherein:

each of the multiple director dipole elements include a middle section attached to the boom, two generally straight parallel end portions, and two connecting portions between the middle section and a corresponding one of the end portions, each of the two connecting portions being curved, angled, or slanted relative to the middle section such that each of the two connecting portions are non-parallel with the middle section and end portions and such that end portions extend above and away from the boom; and/or the reflector dipole element and the director dipole elements are aligned such that a plane defined by end portions of the reflector dipole element and the director dipole elements is spaced apart from the boom and passes between the boom and end portions of the folded dipole element.

14. The Yagi antenna assembly of claim 13, wherein:

the folded dipole element includes the first section and a second section spaced apart from the first section such that a gap is between end portions of the first and second sections and such that the gap is aligned with a center of the boom; and the second cable includes a center conductor that extends across the gap and is electrically connected with the end portion of the second section of the folded dipole element.

15. The Yagi antenna assembly of claim 14, wherein:

the first cable includes a center conductor having a first end portion electrically connected with a first end portion of the center conductor of the second cable; and a second end portion of the center conductor of the second cable extends across the gap to a bushing within the end portion of the second section to thereby electrically connect the center conductor of the second cable to the second section of the folded dipole element.

16. The Yagi antenna assembly of claim 14, further comprising an O-ring disposed around the first cable, the O-ring configured to form a seal between an outer surface of the first cable and an inner surface of the boom.

17. The Yagi antenna assembly of claim 14, further comprising:

a potting material within an open end of the boom through which the first cable is fed into the boom; and a sealing member disposed within an opposite open end of the boom;

whereby the potting material and the sealing member are operable for respectively sealing both the open end and the opposite open end of the boom and inhibiting foreign objects and liquid from entering a hollow interior of the boom.

18. The Yagi antenna assembly of claim 14, further comprising a spring leaf contact coupled to the first cable and in contact with an inside wall of the boom to thereby electrically ground the first cable to the inside wall of the boom.

19. The Yagi antenna assembly of claim 13, wherein:

the folded dipole element includes the first section and a second section;

the first and second sections of the folded dipole element are attached to the boom along opposite sides of the boom; and a joint between the first section of the folded dipole element and the boom is tapered to thereby allow the second cable to pass from inside the boom into the first section of the folded dipole element.

20. A method comprising feeding a feed cable assembly through a first end of a boom of a Yagi antenna assembly into a hollow interior of the boom and into a hollow interior of a first section of a folded dipole element coupled to and/or supported by the boom, such that a first cable of the feed cable assembly is inserted into and extends through the first end of the boom and into the hollow interior of the boom, the first cable electrically grounded to an inside wall of the boom, and such that a second cable of the feed cable assembly, which is electrically connected with the first cable, is inserted into and extends through the hollow interior of the first section of the folded dipole element.

21. The method of claim 20, further comprising:

electrically grounding the first cable of the feed cable assembly to the inside wall of the boom using a spring leaf contact;

sealing the first end of the boom with potting material after the feed cable assembly is fed through the first end of the boom; and sealing a second end of the boom with a sealing member; and wherein:

the Yagi antenna assembly further comprises a reflector dipole element, and multiple director dipole elements spaced apart along the boom; and each of the multiple director dipole elements include a middle section attached to the boom, two generally straight parallel end portions, and two connecting portions between the middle section and a corresponding one of the end portions, each of the two connecting portions being curved, angled, or slanted relative to the middle section such that each of the two connecting portions are non-parallel with the middle section and end portions and such that end portions extend above and away from the boom; and/or the reflector dipole element and the director dipole elements are aligned such that a plane defined by end portions of the reflector dipole element and the director dipole elements is spaced apart from the boom and passes between the boom and end portions of the folded dipole element.

22. The method of claim 20, wherein:

the folded dipole element includes the first section and a second section spaced apart from the first section such that a gap is between end portions of the first and second sections;

wherein feeding the cable assembly comprises:

positioning the first cable within the hollow interior of the boom; and positioning the second cable within the hollow interior of the first section of the folded dipole element such that a center conductor of the second cable extends across the gap and is electrically connected with the end portion of the second section of the folded dipole element.

23. The method of claim 22, wherein:

the center conductor of the second cable extends across the gap to a bushing within the end portion of the second section to thereby electrically connect the center conductor of the second cable to the second section of the folded dipole element via the bushing; and the method further comprises covering the gap and the electrical connection between the bushing and the center conductor of the second cable with at least one of a dielectric member and/or a heat shrink.

* * * * *